US006267633B1

(12) United States Patent
Suganuma

(10) Patent No.: US 6,267,633 B1
(45) Date of Patent: Jul. 31, 2001

(54) REVERSE THRUST BUCKET ASSEMBLY FOR JET PROPULSION UNIT

(75) Inventor: Noboru Suganuma, Shizuoka (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 09/330,367

(22) Filed: Jun. 11, 1999

(30) Foreign Application Priority Data

| | | |
|---|---|---|
| Jun. 11, 1998 | (JP) | 10-163540 |
| Jun. 11, 1998 | (JP) | 10-163618 |
| Sep. 29, 1998 | (JP) | 10-275058 |
| Sep. 29, 1998 | (JP) | 10-275100 |

(51) Int. Cl.[7] ..... B63H 11/11
(52) U.S. Cl. ..... 440/41
(58) Field of Search ..... 440/38–42, 47

(56) References Cited

U.S. PATENT DOCUMENTS

| | | | | |
|---|---|---|---|---|
| 4,026,235 | * | 5/1977 | Woodfill | 440/41 |
| 4,813,895 | | 3/1989 | Takahashi . | |
| 5,154,640 | | 10/1992 | Nakase . | |
| 5,304,078 | | 4/1994 | Kaneko . | |
| 5,350,325 | | 9/1994 | Nanami . | |
| 5,494,464 | | 2/1996 | Kobayashi et al. . | |
| 5,551,898 | | 9/1996 | Matsumoto . | |
| 5,752,864 | * | 5/1998 | Jones et al. | 440/41 |

FOREIGN PATENT DOCUMENTS

| | | | | |
|---|---|---|---|---|
| 2-29892 | | 2/1990 | (JP) . | |
| 0065492 | * | 3/1991 | (JP) | 440/41 |

* cited by examiner

*Primary Examiner*—Ed Swinehart
(74) *Attorney, Agent, or Firm*—Knobbe, Martens, Olson & Bear, LLP

(57) ABSTRACT

A watercraft includes an improved reverse thrust deflector assembly includes a locking mechanism that cooperates with first and second stops. The first stop establishes a raised position of a thrust deflector and the second stop established a lowered position of the thrust deflector. When in each of these positions, the locking mechanism engages the corresponding stop to inhibit unintentionally movement of the thrust deflector. The thrust deflector assembly includes a mounting bracket assembly that supports the thrust deflector about the discharge end of a corresponding jet propulsion unit. The bracket assembly extends forward of a discharge end of a discharge nozzle to support the rust deflector at a position closer to the discharge end of a steering nozzle of the propulsion unit. The bracket assembly also includes hollow passageways through which various conduits and cables, which are used with the jet propulsion unit, can be routed.

46 Claims, 21 Drawing Sheets

REVERSE THRUST BUCKET ASSEMBLY FOR JET PROPULSION UNIT

BACKGROUND OF THE INVENTION

1. Field of the Invention

The present invention relates to a jet propulsion unit for a watercraft, and more particularly to a reverse thrust deflector assembly.

2. Description of Related Art

Personal watercraft have become very popular in recent years. This type of watercraft is quite sporting in nature and carries a rider and possibly one or two passengers. A relatively small hull of the personal watercraft commonly defines a riders' area above an engine compartment. An internal combustion engine frequently powers a jet propulsion unit which propels the watercraft. The engine lies within the engine compartment in front of a tunnel formed on the underside of the watercraft hull. The jet propulsion unit is located within the tunnel and is driven by an output shaft of the engine. In particular, an impeller shaft of the jet propulsion unit extends forward, through a wall of the hull tunnel, and is coupled to the engine output shaft. In this manner, the engine drives the jet propulsion unit.

The jet propulsion unit conventionally includes an impeller housing in which an impeller is contained. The impeller, which is driven by the engine through the impeller shaft, draws water through a water inlet and forces it through a discharge nozzle to propel the watercraft. A steering nozzle usually is mounted on the discharge nozzle for pivotal movement about a vertical axis. Pivotal movement of the steering nozzle about the vertical steering axis alters a discharge direction of the water jet to steer the watercraft.

Many personal watercraft also include a reverse thrust deflector to issue water forwardly and produce a reverse thrust. A pair of support arms typically support the reverse thrust deflector about the end of the jet propulsion unit. These arms usually are pivotally mounted onto the discharge nozzle or onto a ride plate that extends beneath at least a portion of the jet propulsion unit. The pivotal movement of the arms moves the reverse thrust deflector from a raised position, in which the deflector does not affect the water jet issuing from the steering nozzle, and a fully lowered position, in which the deflector cooperates with the steering nozzle and redirects water issuing from the jet propulsion unit forwardly to achieve a reverse thrust. In some prior watercraft, the reverse thrust deflector also assumes an intermediate position which corresponds to a neutral position.

Both the steering nozzle and the reverse thrust deflector are pivotally supported and are operated remotely. As such, each requires separate actuation mechanisms that must not interfere with each other. That is, the mechanism for actuating the reverse thrust deflector, which pivots about a horizontally disposed axis, must not interfere with the mechanism that affects the steering of the watercraft. For this reason, first and second flexible wire actuators usually are employed to operate the steering nozzle and the reverse thrust deflector, respectively. The layout of these components and actuators though typically is complicated owing to the tight confined area of the tunnel in which the components and actuators are disposed.

Prior the buckets are also prone to bouncing up and down when the watercraft is operated in reverse with the thrust bucket in the lowered position. The thrust bucket under some conditions or after repeated use may become worn and tend to rattle and move about when raised.

SUMMARY OF THE INVENTION

A need therefore exists for a reverse thrust deflector assembly which prevents the deflector from bouncing when in a lowered position and prevents the deflector from falling when in the raised position. The reverse thrust deflector assembly also desirably provides a compact support assembly for the thrust deflector and improves the arrangement of various components used with the thrust deflector and the propulsion system.

An aspect of the present invention involves a jet propulsion unit for a watercraft that comprises an impeller disposed within a housing assembly. A nozzle is arranged downstream of the impeller and a thrust deflector is pivotally supported relative to the nozzle and movable between a first position and a second position. The rust deflector is disposed relative to the nozzle so as to redirect at least a portion of the water stream issuing from the nozzle when the thrust deflector is moved into the second position. First and second stops are provided which cooperate with the thrust deflector to define the first and second positions. A releasable locking mechanism is attached to the thrust deflector, and engages the first stop or the second stop when the rust deflector is positioned in the first position or the second position, respectively. A lost motion connection operates between the thrust deflector and the locking mechanism so as to release the locking mechanism from one of the stops to move the thrust deflector from at least one of the positions.

The jet propulsion unit desirably is combined with a personal watercraft that includes a hull defining a rider's area and an engine compartment. An engine is disposed within the engine compartment and includes an output shaft. The jet propulsion unit is coupled to the engine output shaft In one variation, a remote operator is disposed near the rider's area and is coupled to the thrust deflector by an actuator mechanism to move the thrust deflector between the first and second positions.

In an additional variation, the nozzle is rotatable between a fully trimmed-up position and a fully tried-down position. In the fully trimmed-down position, a central axis of the nozzle is skewed at a discharge angle relative to a central axis of the jet propulsion unit. The thrust deflector includes at least one inclined, laterally extending rib that is positioned on a side of the thrust deflector that faces the nozzle, and is oriented at an inclined angle relative to the central axis of the jet propulsion unit. The inclined angle of the rib is larger than the discharge angle of the nozzle when fully trimmed down so as to guide at least portion of the water issuing from the nozzle even when the nozzle is in the fully trimmed-down position.

Another aspect of the present invention involves a bracket assembly that supports the thrust deflector about a jet propulsion unit which includes a discharge nozzle and a steering nozzle. The discharge nozzle and the steering nozzle are arranged downstream of the impeller and in series such that the steering nozzle receives water issuing from the discharge nozzle. The bracket assembly includes a pair of arms that are attached to the discharge nozzle. The arms extend at least toward the steering nozzle, and the thrust deflector is pivotally coupled to the arms. In one mode, the thrust deflector is pivotally coupled to the arms at a point near an effluent end of the discharge nozzle. In an additional variation, the arms of the bracket assembly extend along at least a portion of the sides of the steering nozzle.

At least one of the arms desirably defines a hollow space extending alongside the jet propulsion unit. An actuator, which is coupled to the steering nozzle, is disposed within this hollow space. In addition, additional actuators and/or conduits can also be disposed in this space.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of preferred embodiments of the present reverse thrust deflector assembly in the context of a personal watercraft. The illustrated embodiments of the watercraft exhaust system are intended to illustrate, but not to limit the invention. The drawings contain the following figures.

DETAILED DESCRIPTION OF PREFERRED EMBODIMENTS

Figure 1:
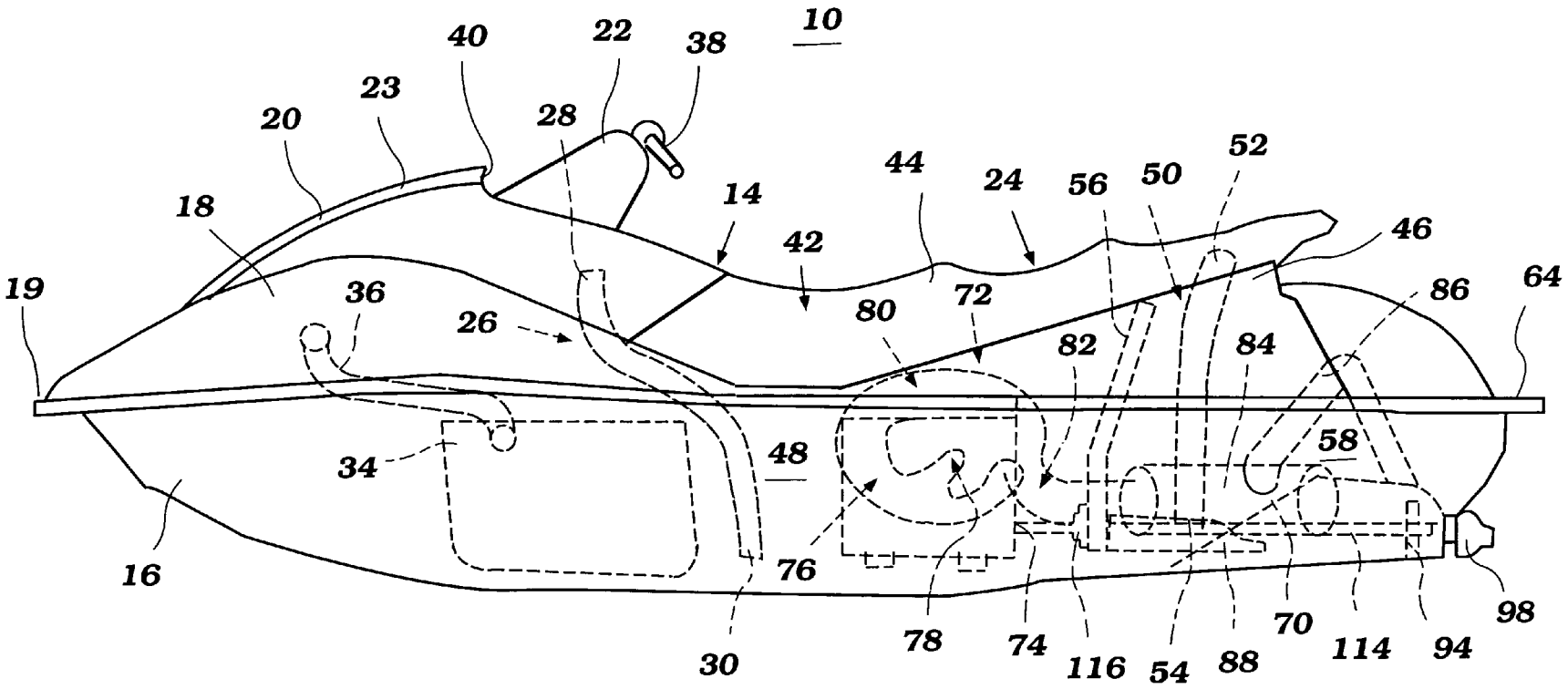
FIG. 1 is a side elevational view of a personal watercraft including an reverse thrust deflector assembly configured in accordance with a preferred embodiment of the present invention, and illustrates several internal components of the watercraft in phantom.
Figure 2:
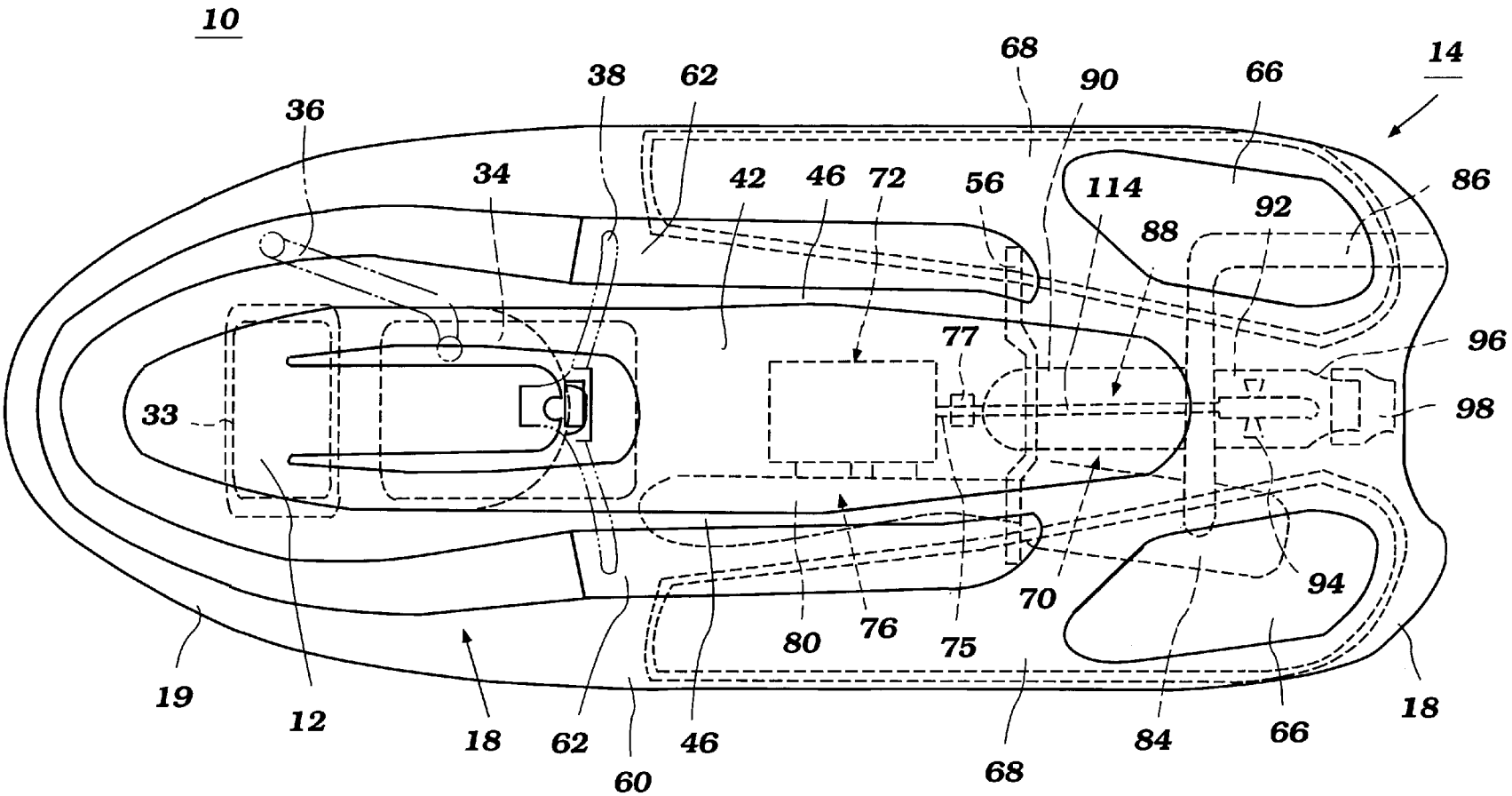
FIG. 2 is a top view of the personal watercraft of FIG. 1 with several internal components of the watercraft illustrated in phantom.

FIGS. 1 and 2 illustrate a personal watercraft 10 which includes a reverse thrust deflector assembly 12 configured in accordance with a preferred embodiment of the present invention. Although the present reverse thrust deflector assembly 12 is illustrated in connection with a personal watercraft, the reverse thrust deflector assembly can be used with other types of watercraft as well, such as, for example, but without limitation, small jet boats and the like. Before describing the reverse thrust deflector assembly 12, an exemplary personal watercraft 10 will first be described in general details to assist the reader's understanding of the environment of use and the operation of the reverse thrust deflector assembly 12.

The watercraft 10 includes a hull 14 formed by a lower hull section 16 and an upper deck section 18. The hull sections 16, 18 are formed from a suitable material such as, for example, a molded fiberglass reinforced resin. The lower hull section 16 and the upper deck section 18 are fixed to each other around the peripheral edges 19 in any suitable manner.

As viewed in the direction from the bow to the stem of the watercraft, the upper deck section 18 includes a bow portion 20, a control mast 22 and a rider's area 24. The bow portion 20 slopes upwardly toward the control mast 22 and desirably includes an air plenum that receives atmospheric air through at least one intake opening (not shown). At least one air duct 26 communicates with the air plenum through an upper end 28 positioned within the plenum. A lower end 30 is positioned near the lower hull portion 16 within the hull 14, so that air can enter the hull, and under some running conditions, can be vented from the hull 14. A hatch cover 32 desirably extends above an opening to the air plenum to inhibit an influx of water into the hull.

A storage compartment 33 is also disposed within the bow portion 20 and is located beneath the hatch 32. The hatch can be raised or removed to gain access to the storage compartment. In the illustrated embodiment, at least a portion of the storage compartment is arranged forward of the fuel tank 34.

A fuel tank 34 is located within the hull 14 beneath the hatch cover 32. Conventional means, such as, for example, straps, secure the fuel tank 34 to the lower hull 16. A fuel filler hose 36 extends between a fuel cap assembly and the fuel tank 34. In the illustrated embodiment, the filler cap assembly (not shown) is secured to the bow portion 20 of the hull upper deck 18 and to the side and in front of the control mast 22. In this manner, the fuel tank 34 can be filled from outside the hull 14 with the fuel passing through the fuel filler hose 36 into the tank 34.

The control mast 22 extends upward from the bow portion 20 and supports a handlebar assembly 38. The handlebar 38 controls the steering of the watercraft 10 in a conventional manner. The handlebar assembly 38 also carries a variety of controls of the watercraft 10, such as, for example, a throttle control, a start switch and a lanyard switch.

A display panel 40 desirably is located in front of the control mast 22 on the bow portion 20 and is orientated to be visible by the rider. The display panel desirably displays a number of performance characteristics of the watercraft such as for example, watercraft speed (via a speedometer), engine speed (via a tachometer), fuel level, oil level, engine temperature, battery charge level and the like.

The rider's area 24 lies behind the control mast 22 and includes a seat assembly 42. In the illustrated embodiment, the seat assembly 42 has a longitudinally extending straddle-type shape that may be straddled by an operator and by at least one, two or three passengers. The seat assembly 42, at least in principal part, is formed by a seat cushion 44 supported by a raised pedestal 46. The raised pedestal 46 has an elongated shape and extends longitudinally along the center of the watercraft 10. The seat cushion 44 desirably is removably attached to a top surface of the pedestal 46 and covers the entire upper end of the pedestal for rider and passenger comfort. The seat cushion 44 can also be split into two or more sections.

An access opening (not shown) is located on an upper surface of the pedestal 46. The access opening opens into an engine compartment 48 formed within the hull 14. The seat cushion 44 normally covers and seals closed the access opening. When the seat cushion 44 is removed, the engine compartment 48 is accessible through the access opening.

The pedestal 46 also desirably includes at least one air duct so located behind the access opening. An upper end 52 of the rear air duct communicates with the atmosphere through a space between the pedestal 46 and the cushion 44 which is formed behind the access opening. A lower end 54 of the rear air duct 50 is positioned within the hull 14 near the lower hull portion 16. Air passes through the rear duct 50 in both directions.

In the illustrated embodiment, a bulkhead 56 extends between at least a portion of the side walls of the lower hull portion 16. The bulkhead 56 divides a pump chamber 58 from the engine compartment 48 within the hull 14.

As seen in FIG. 2, the upper deck section 18 of the hull 14 advantageously includes a pair of raised gunnels 60 positioned on opposite sides of an aft portion of the upper deck assembly 18. The raised gunnels 60 define a pair of foot areas 62 that extend generally longitudinally and parallel to the sides of the pedestal 46. In this position, the operator and any passengers sitting on the seat assembly 42 can place their feet in the foot areas 62 with the raised gunnels shielding the feet and lower legs of the riders. A non-slip (e.g., rubber) mat desirably covers the foot areas 62 to provide increased grip and traction for the operator and the passengers.

Figure 3:
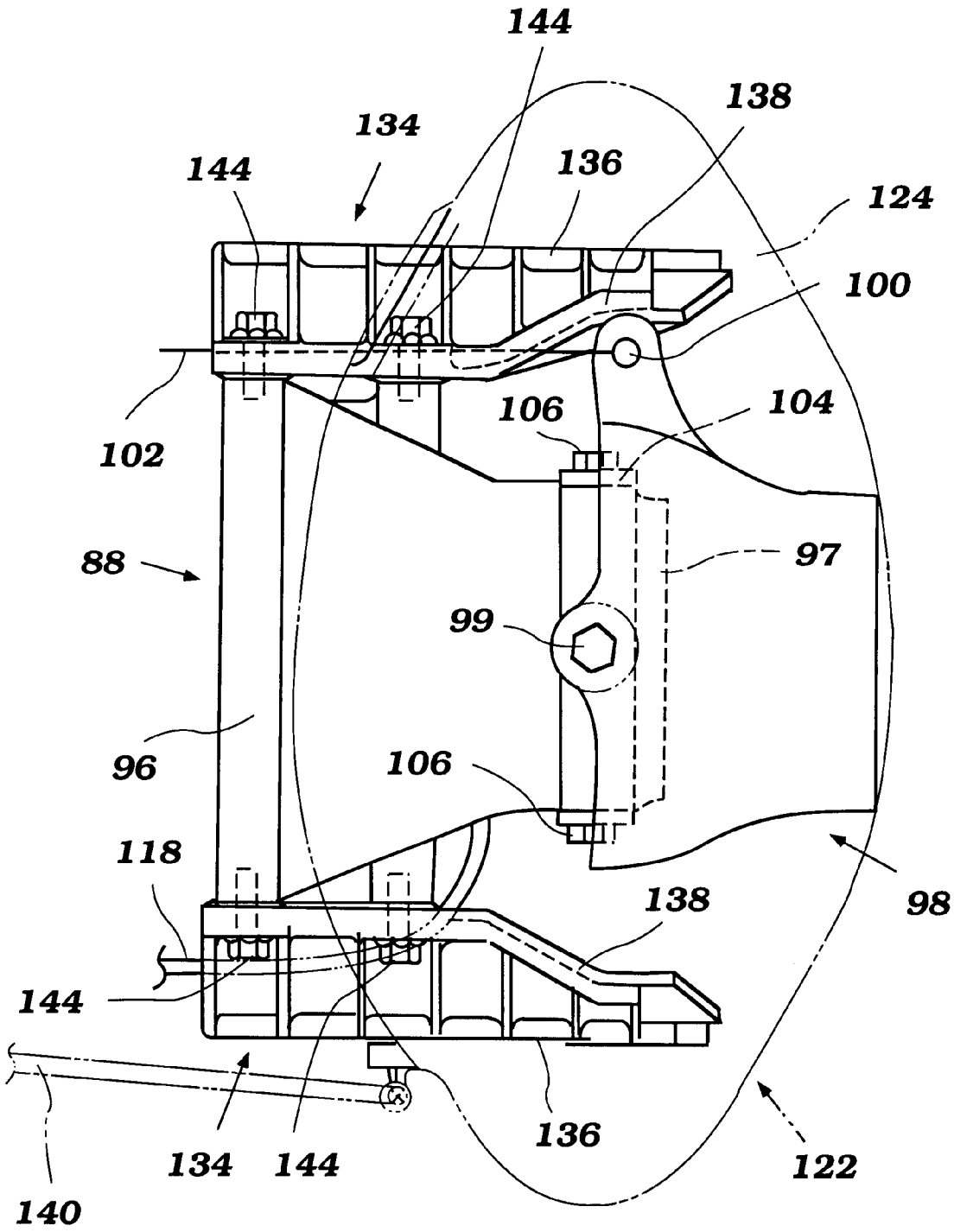
FIG. 3 is an enlarged top plan view of the discharge end of the jet propulsion unit and mounting brackets of the reverse thrust deflector assembly, with the balance of the assembly removed and the reverse thrust deflector illustrated by phantom line in the raised position.

The upper deck assembly 18 also includes an aft deck section 64, as best seen in FIG. 1. An aft section of the upper deck assembly 18 rises up from the deck 64 and merges into the raised gunnels 60 and the seat pedestal 46, as seen in FIG. 3. This portion of the upper deck assembly 18 separates the aft deck 64 from the foot areas 62. Although not illustrated, a drainage conduit can extend between the foot areas 62 and the aft deck 64, or from the foot areas 62 to a discharge port located on the exterior of the watercraft hull 14.

As seen in FIG. 2, the aft section of the upper deck assembly 18 includes a pair of hatches 66. The hatches open into storage compartments or areas 68 that extend forward from an aft end of the watercraft hull 14 along the side of the rider area 24 to a point proximate the steering column 22. It is understood, however, that these storage areas 68 can have a shorter or longer length. The length of the storage areas 68, however, desirably are sufficiently long so as to receive the types of articles which are popularly carried by personal watercraft, such as, for example, water skis, wakeboards, umbrellas, fishing poles, and the like. As seen in FIG. 2, at least a portion of these aft storage areas extend below the raised gunnels 60 and the foot areas 62 so as to accommodate wider articles, such as a wakeboard. The hatches 66 desirably are hinged along their sides (i.e., either on a star board side or a port side) in order to ease insertion of elongated items into the storage compartments 68. In one mode, the hatches 66 may be hinged along their outer sides so as to be easily accessible by a rider or passenger located within the rider area 64.

The lower hull portion 16 principally defines the engine compartment 48. Except for the air ducts 26, 50, the engine compartment 48 is normally substantially sealed so as to enclose an engine of the watercraft 10 from the body of water in which the watercraft is operated.

The lower hull 16 is designed such that the watercraft 10 planes or rides on a minimum surface area at the aft end of the lower hull 16 in order to optimize the speed and handling of the watercraft 10 when up on plane. For this purpose, the lower hull section generally has a V-shaped configuration formed by a pair of inclined section that extend outwardly from a keel line of the hull to the hull's side walls at a dead rise angle. The inclined sections also extend longitudinally from the bow toward the transom of the lower hull 16. The side walls are generally flat and straight near the stem of the lower hull and smoothly blend towards the longitudinal center of the watercraft at the bow. The lines of intersection between the inclined section and the corresponding side wall form the outer chines of the lower hull section.

Toward the transom of the watercraft, the incline sections of the lower hull 16 extend outwardly from a recessed channel or tunnel 70 that extends upward toward the upper deck portion 16. The tunnel 70 has a generally parallelepiped shape and opens through the rear of the transom 43 of the watercraft 10, as seen in FIG. 1.

An internal combustion engine 72 powers the watercraft 10. The engine 72 is positioned within the engine compartment 48 and is mounted primarily beneath the seat assembly 42. Vibration-absorbing engine mounts secure the engine 72 to the lower hull portion 16 in a known manner. The engine 72 is mounted in approximately a central position in the watercraft 10.

In the illustrated embodiment, the engine 72 includes two in-line cylinders and operates on a two-stroke, crankcase compression principle. The engine 72 is positioned such that the row of cylinders lies parallel to a longitudinal axis of the watercraft 10, running from bow to stern. The axis of each cylinder is skewed or inclined relative to a vertical central plane of the watercraft 10, in which the longitudinal axis lies. This engine type, however, is merely exemplary. Those skilled in the art will readily appreciate that the present reverse thrust deflector assembly can be used with any of a variety of engine types having other number of cylinders, having other cylinder arrangements and operating on other combustion principles (e.g., four-stroke principle).

A cylinder block and a cylinder head assembly desirably form the cylinders of the engine 72. A piston reciprocates within each cylinder of the engine 72 and together the pistons drive an output shaft 74 (FIG. 1). A connecting rod links the corresponding piston to a crankshaft 75 of the engine 72, which in time is drivingly connected to the output shaft 74 by a coupling 77. The corresponding cylinder bore, piston and cylinder head of each cylinder forms a variable-volume chamber, which at a minimum volume defines a combustion chamber.

The crankshaft desirably is journaled with a crankcase, which in one variation, is formed between a crankcase member and a lower end of the cylinder block. Individual crankcase chambers of the engine are formed within the crankcase by dividing walls and sealing disks, and are sealed from one another with each crankcase chamber communicating with a dedicated variable-volume chamber.

Each crankcase chamber also communicates with an intake passage of an induction system (not shown) through a check valve (e.g., a reed-type valve). In one variation, the intake passage is integrally formed with the crankcase member; however, the engine 72 can also use a separate intake manifold equally well. A charge former (e.g., a carburetor) of the induction system communicates with an inlet end of the intake passage. The charge former system receives fuel from the fuel tank 34 and produces the fuel charge which is delivered to the cylinders in a known manner. In the illustrated embodiment, an air intake silencer is connected to an air inlet end of a throttle passage of each charge former. The flow path from the air intake silencer, through the charger former and intake passage and into the corresponding crankcase chamber desirably is along a flow axis which generally is inclined relative to the central vertical plane and lies on a side of the plane opposite of the corresponding cylinder. Because the internal details of the engine 72 and the induction system desirably are conventional, a further description of the engine construction is not believed necessary to understand and practice the invention.

An exhaust system 76 discharges engine by-products from the engine 72 to the atmosphere and/or to the body of water in which the watercraft 10 is operated. As best seen in FIGS. 1 and 2, the exhaust system includes an exhaust manifold 78 that is attached to the side of the engine cylinder block and which receives exhaust gases from the combustion chamber through exhaust ports in a well known manner. For this purpose, the exhaust manifold 78 desirably includes a number of runners equal to the number of cylinders of the engine 72. Each runner communicates with the exhaust port(s) of the respective cylinder. The runners of the exhaust manifold 78 thence merge together at a merge point to form a common exhaust path that terminates at an outlet end of the manifold 78.

An outlet end of the exhaust manifold 78 communicates with an expansion chamber 80 of the exhaust system 76. In one variation, the expansion chamber 80 may be located toward an upper end of the engine 72 between the side walls of the seat pedestal 46. In other variations, the expansion chamber 80 may be located on the front side of the engine 72 or on a lower side of the engine 72 and positioned at least partially below the foot areas 62. In the illustrated mode, however, the expansion chamber 80 is located along an upper side of the engine 72 and turns downward to communicate with a connecting pipe 82. A downstream end of the connection pipe 82 communicates with a watertrap 84. The watertrap 84 has a sufficient volume to retain water and preclude a backflow of water to the expansion chamber 80 and the engine 72. Internal baffles within the watertrap 84 help control waterflow through the exhaust system 76.

An exhaust discharge pipe 86 extends from an outlet port of the watertrap 84 and wraps over the top of the tunnel 70 to a discharge opening. The discharge opening desirably opens into the tunnel 70 or through the transom of the watercraft 10 in an area that is close to or actually below the water level when the watercraft is floating at rest in the body of water in which it is operated.

With reference to FIGS. 1–4, a jet propulsion unit 88 propels the watercraft 10. The jet propulsion unit 88 is mounted within the tunnel 70 formed on the underside of the lower hull section 16 by a plurality of bolt. An intake duct 90 of the jet propulsion unit 88 defines an inlet opening that opens into a gullet. The gullet leads to an impeller housing assembly 92 in which the impeller 94 of the jet pump 88 operates. An impeller housing assembly 92 also acts as a pressurization chamber and delivers the water flow from the impeller housing to a discharge nozzle 96.

Figure 4:
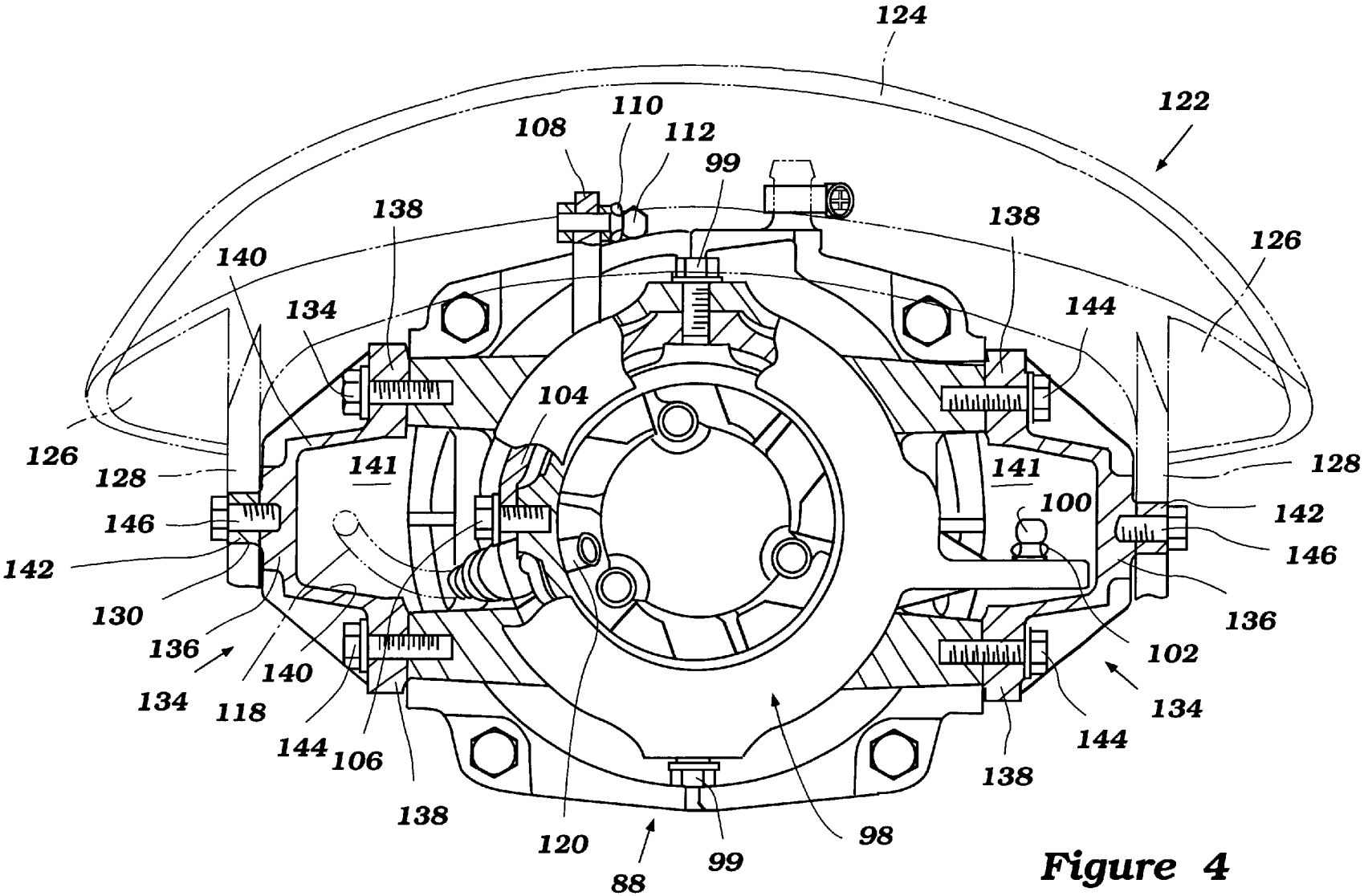
FIG. 4 is a rear elevational view of the discharge end of the jet propulsion unit and the mounting brackets of FIG. 3, with the reverse thrust deflector illustrated by phantom lines in a raised position.

As best seen in FIGS. 3 and 4, a steering nozzle 98 is supported at the downstream end 97 of the discharge nozzle 96 by a pair of vertically extending pivot pins 99. In an exemplary embodiment, as seen in FIG. 3, the steering nozzle 98 has an integral lever 100 on one side that is coupled to the handlebar assembly 38 through, for example, a bowden-wire actuator 102, as known in the art. In this manner, the operator of the watercraft can move the steering nozzle 98 to effect directional changes of the watercraft 10.

As discussed in more detail below, the steering nozzle 98 may also be supported by a gimble ring 104 to allow the steering nozzle 98 to pivot around a generally horizontally extending access pins 106 effect changes in the trim position of the steering nozzle 98. For this purpose, the steering nozzle 98 is supported relative to the gimble ring 104 by a pair of horizontally extending pins 106. A lever 108 is coupled to an actuator 110 that is also coupled to a remote operator position near the rider's area 24 on the watercraft hull 14. In the illustrated embodiment, an actuator linkage 110 is connected to the lever 108 by a conventional ball coupling 112 on the upper side of the jet propulsion unit 88. The lever 110 desirably is driven by a conventional electronic trim adjustment system controlled by a lever switch located in proximity of the control column 22 (e.g., a switch located on the handlebar assembly 38). Alternatively, the actuator can include a bowden wire cable which is driven by either an electrical actuator or a mechanical actuator, both of which can be operable by an operator located remotely on the hull 14, either in or near the rider's area 24.

Such mechanical or electrical actuation mechanisms can be located in the tunnel, or in the hull, either in the propulsion compartment 58 or the engine compartment 48.

A ride plate (not shown) covers a portion of the tunnel 70 behind the inlet opening to enclose at least partially the pump assembly and the nozzle assembly of the propulsion unit 88 within the tunnel 70. In this manner, the lower opening of the tunnel 70 is closed to provide a planing surface for the watercraft 10.

As best seen in FIGS. 2 and 3, an impeller shaft 114 supports the impeller 94 within the impeller housing of the unit 88. The aft end of the impeller shaft is suitable supported and journaled within the compression chamber of the assembly in a known manner. The impeller shaft extends in the forward direction through a front wall of the tunnel 70 and through the bulkhead 56. A sealed coupling 116 supports and journals the front end of the impeller shaft 114 and couples the shaft 114 to the engine output shaft 174. In this manner, the engine 72 drives the propulsion unit 88.

The propulsion unit 88 supplies cooling water through a conduit to an engine cooling jacket. For this purpose, an outlet port is formed on the housing the pressurization chamber assembly of the jet pump 88. The conduit is coupled to the outlet port and extends to an inlet port to the engine water jacket. In one variation, the conduit may be integrally formed with the housing assembly 92 of the propulsion unit 88.

The watercraft 10 also includes a bilge system to remove water which may have entered through the air ducts 26, 50, or through other openings in the hull, from the engine compartment 48 and/or the propulsion compartment 58. In the illustrated mode, the bilge system includes a pickup (not shown), that is located either in the engine compartment 48 or the propulsion compartment 58. A conduit 118 connects the pickup with a port 120 located in the discharge nozzle 96 as seen in FIG. 4.

The personal watercraft 10 so far described represents only an exemplary watercraft on which the present exhaust system 12 can be employed. A further description of the personal watercraft 10 is not believed necessary for an understanding and an appreciation of the present reverse thrust deflector assembly 12. The reverse thrust deflector assembly will now be described in detail.

The reverse thrust deflector assembly 12 includes a thrust deflector 122 pivotally supported about the discharge end of the jet propulsion unit 88. In the illustrated embodiment, the thrust deflector 122 is a reverse thrust bucket mounted on the discharge end of the propulsion unit 88 to move between a raised position and a lowered position. When in the lower position, the thrust deflector 122 redirects at least a portion of the water issuing from the steering nozzle 98 in a forward direction to propel the watercraft in reverse.

The reverse thrust deflector has an elongated, bowl-like body 124 with an arcuate inner surface 126 that faces the discharge nozzle 98 when in the lowered position. A pair of support arms 128 support the body 124 of the reverse thrust deflector 122 about the steering nozzle 98. In the illustrated embodiment, the reverse thrust deflector 122 is secured onto the propulsion unit 88. However, in another form, various aspects of the present reverse thrust deflector assembly (e.g., the below described locking mechanism) can be used when the reverse thrust deflector 122 is supported by either the ride plate or a bracket secured to the watercraft hull 114.

Figure 5:
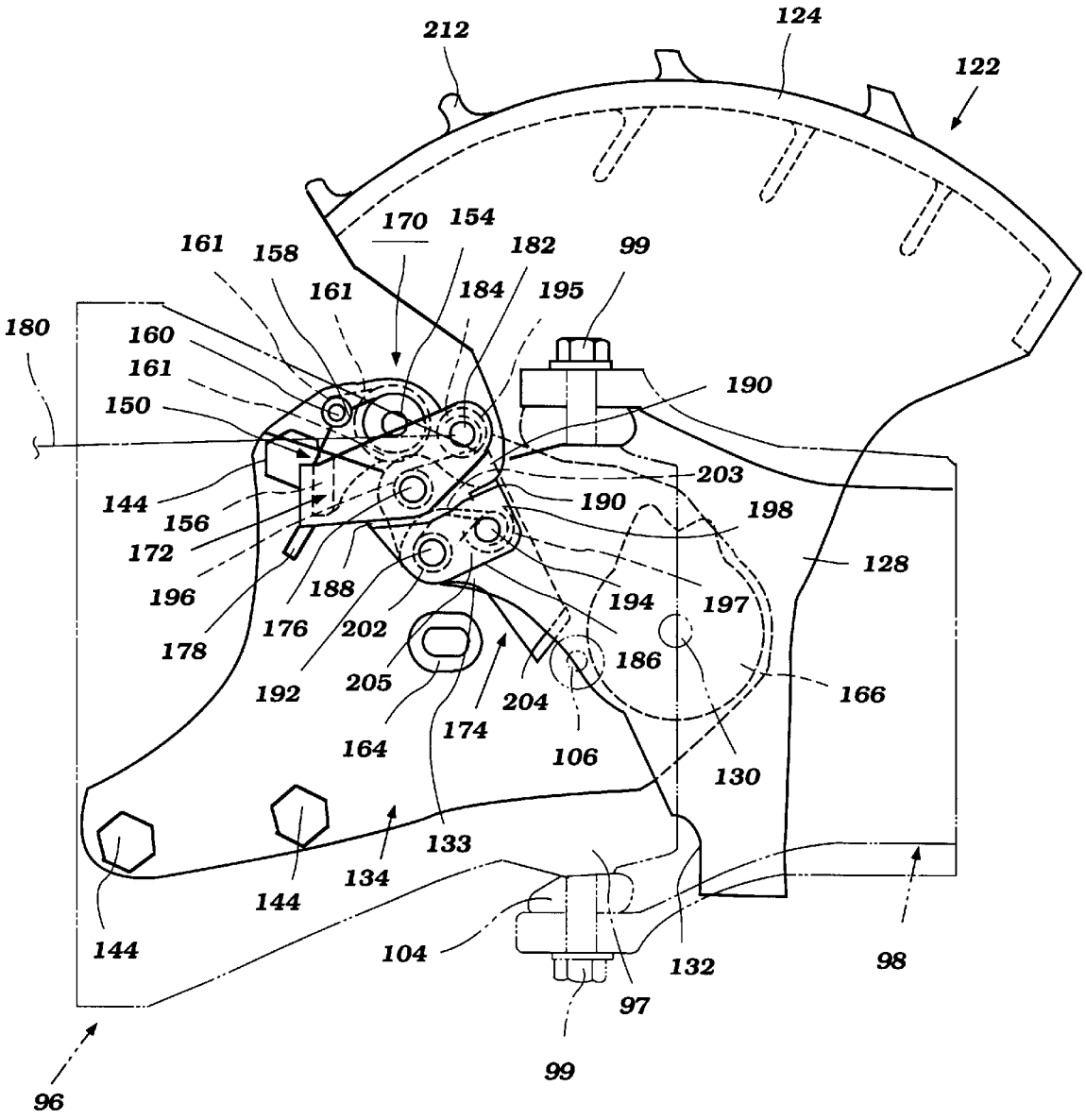
FIG. 5 is a side elevational view of the reverse thrust deflector assembly of FIG. 3, as positioned on a discharge end of a jet propulsion unit of the personal watercraft and with a reverse thrust deflector in a raised position.
Figure 8:
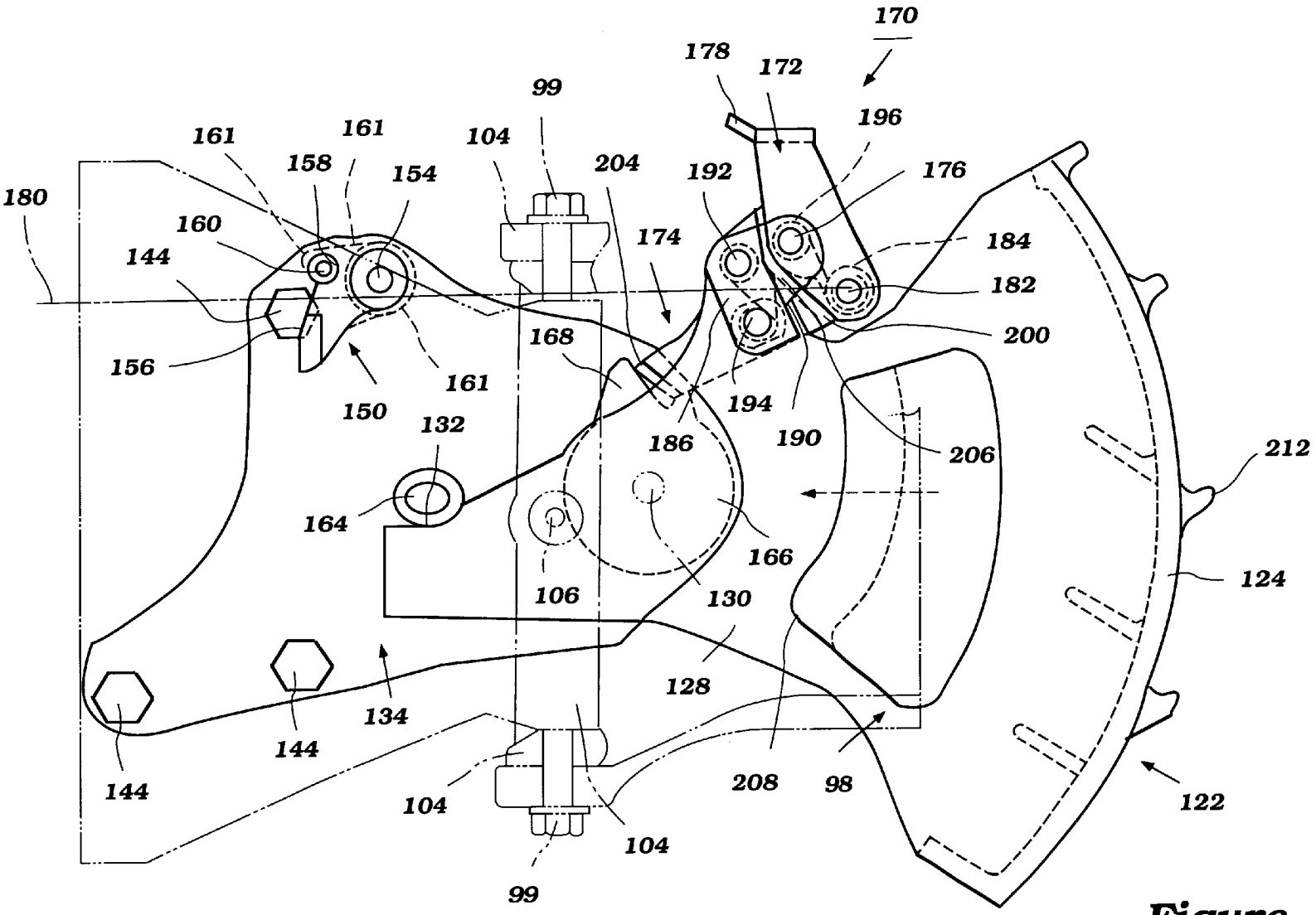
FIG. 8 is a side elevational view of the reverse thrust deflector assembly of FIG. 3 with the reverse thrust deflector in a lowered position.

As best seen in FIGS. 5 and 8, each support arm 128 extends from the inner surface 126 of the deflector body 124. Each arm 128 includes a pivot hole 130 located at a position outside of the deflector body 122. The arm 128 extends beyond the pivot hole 130 and terminates at an outer end. An abutment surface 132 is formed on a side edge at the outer end of each support arm 128.

At least one of the support arms 128 of the thrust deflector 122 includes a mounting area 133 that extends from a front/upper edge of the respective support arm. Additional components of the reverse thrust deflector assembly are mounted onto this mounting area 133, as described in greater detail below. Additional details of the reverse thrust deflector will be provided below.

A bracket assembly supports the reverse thrust deflector 122 on the propulsion unit 88. In the illustrated embodiment, as best seen in FIGS. 3 and 4, the bracket assembly includes a pair of brackets 134. In the illustrated embodiment, each bracket 134 has substantially identical shapes, and therefore, the description herein of one will be understood as applying to both unless indicated otherwise.

As seen in FIG. 3, each bracket has a length at least as long as the discharge nozzle 96, and preferably extends beyond a discharge end 97 of the discharge nozzle 96. The bracket 134 also includes a generally straight outer wall 136. An inner edge of each bracket 134, which is defined by a pair of mounting flanges 138 as best seen in FIG. 4, jogs outward toward a rear end of each bracket 134 such that the spacing between the outer wall 136 and the inner edge is decreased. As a result, as seen in FIG. 3, the spacing between the brackets 134 increase toward the outer ends of the brackets 134 providing clearance for the steering movement of the steering nozzle 98.

As best seen in FIG. 4, each bracket 134 generally have a channel-like shape defined by the outer wall 136 in a pair of longitudinally extending walls 140. In the illustrated embodiment, the longitudinally extending walls 140 diverge toward the inner side of each bracket 134, and each wall 140 terminates in one of the mounting flanges 138.

Each mounting flange 138 extends outward from a resulting channel 141 and generally parallel to the outer wall 136. As understood from FIGS. 3 and 4, each bracket 134 also includes a plurality of stiffening ribs that extend between each mounting flange 138 and the outer wall 136. The outer wall 136 also includes a cylindrical boss 142 that projects outwardly.

The brackets 134 are attached to the discharge nozzle 96, as seen in FIGS. 3 and 4. For this purpose, the discharge nozzle includes a plurality of tapped holes at the fore end of the housing 96 and a plurality of bosses that extend outwardly from the tapered section of the discharge nozzle 96. Each boss includes a tapped hole. The brackets 134 are positioned next to the discharge nozzle 96 and are secured thereto by a plurality of fasteners 144 with the mounting flanges 138 abutting the ends of the bosses and the fore end of the housing 96.

As seen in FIG. 4, the channel 141 formed by each bracket 134 provides a space through which to route various conduits and actuators attached to the jet propulsion unit 88. In the illustrated embodiment, the bilge conduit 118 is routed through the channel 141 on one side of the discharge nozzle 96, and the bowden wire cable 102 attached to the steering lever 100 is routed through the channel 141 on the opposite side of the discharge nozzle 96. The brackets 134 thus shield these components as well as ease the layout of such components alongside the propulsion unit 88.

The reverse thrust deflector 122 is attached onto the support brackets 134. Each support arm 128 of the thrust deflector 122 fits over the cylindrical boss 142 on the outer side of each bracket 134 with the pivot hole 130 of the support arm 128 receiving the boss 142. A fastener 146 secures the support arms 128 onto the outer sides of the brackets 134. The cylindrical bosses 142 act as a bushing about which the support arms 128, and thus the thrust deflector 122, pivot when actuated from the raised position to the lower position, and vice versa.

Figure 6:
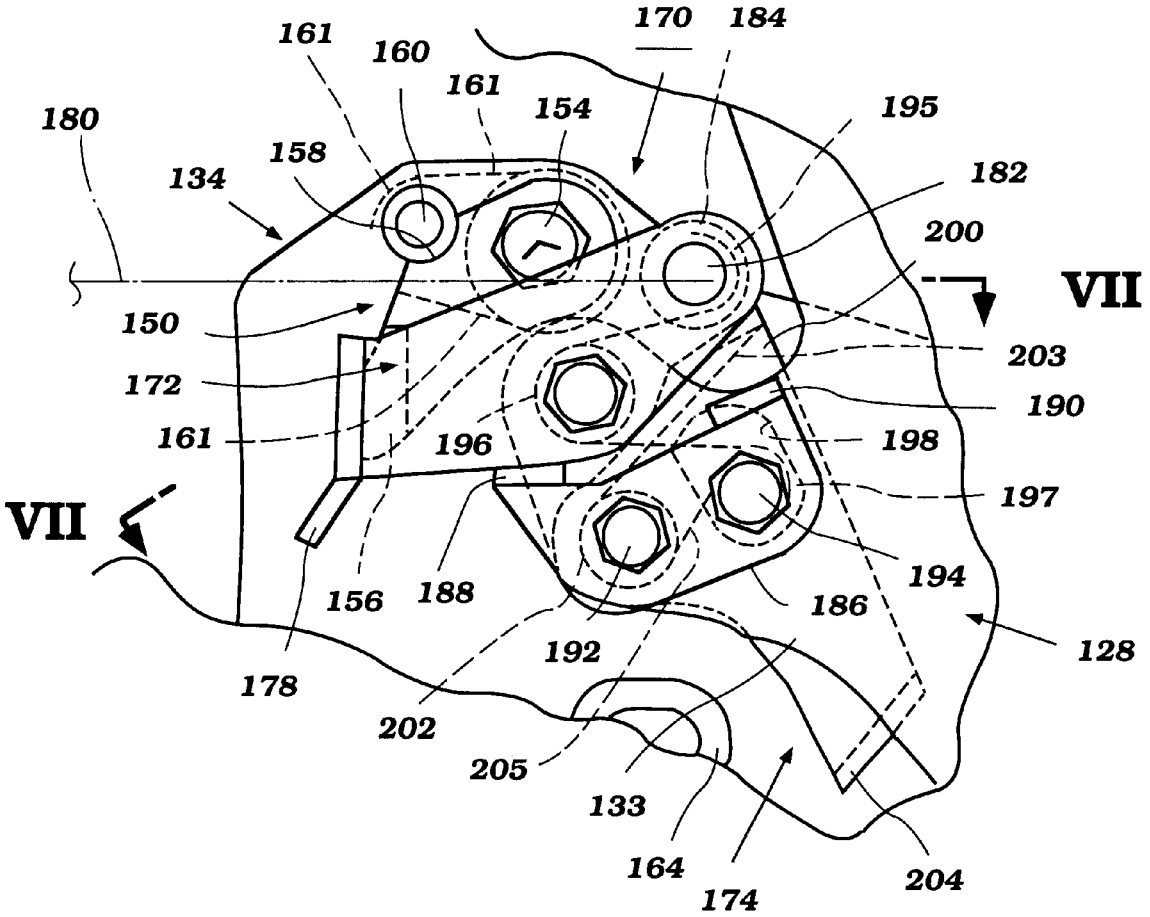
FIG. 6 is an enlarged side view of a locking mechanism of the reverse thrust deflector assembly shown in FIG. 5, as engaged to a first stop that defines the raised position of the reverse thrust deflector.
Figure 7:
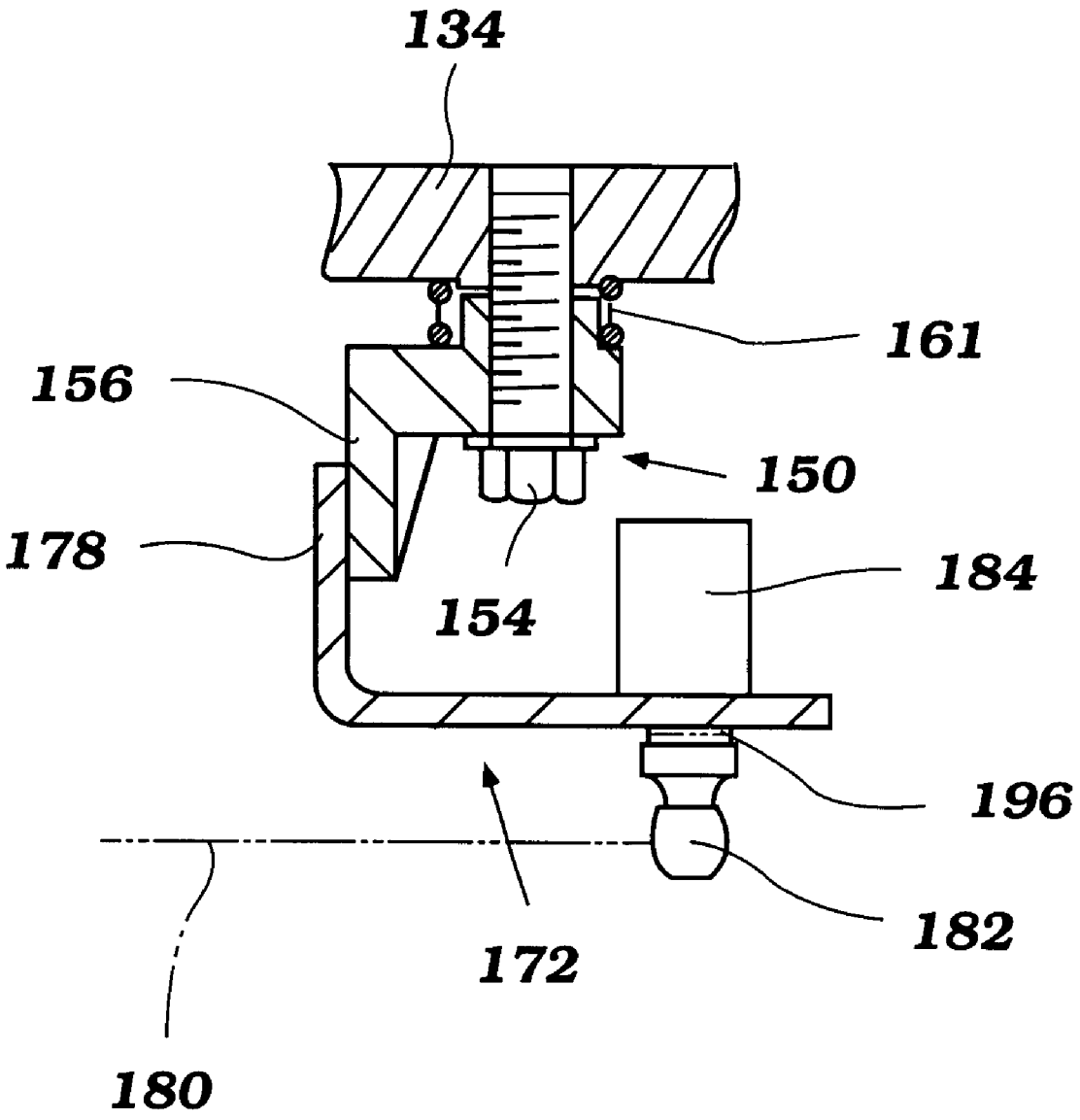
FIG. 7 is a cross-sectional view of a drive member of the locking mechanism and a rotatable stop element of the first stop, which is affixed onto a portion of a mounting bracket, as taken along line VII—VII of FIG. 6.

First and second stop mechanisms, which are arranged on at least one of the support brackets 134, are provided to establish the raised and lower positions of the Crust deflector 122. In the illustrated embodiment, as best seen in FIGS. 5–7, the first stop 150 includes a rotatable stop element 152 that rotates about a supporting bolt 154. The outer end of the rotatable stop element 152 includes an abutment surface 156. The stop element 152 also includes an arcuate indent 158. An engagement pin 160 projects from the support bracket 134 and cooperates with the indent 158 to limit the rotation of the stop element 152. A torsion spring 161 operates between the rotatable stop element 152 and the engagement pin 160 to bias the stop element 152 against the engagement pin 160.

The second stop element 162, in the illustrated embodiment, includes an abutment stop 164 attached to the bracket 134 and a latch 166 positioned on an outer side of the bracket 134, but inside the support arm 128 of the thrust deflector 122. The latch 166 is fixed onto the bracket 134 and includes a latching notch 168 disposed on its upper end.

The abutment stop 164 is positioned to interact with the abutment surface 132 of the support arm 128 when the thrust deflector 122 is in its lowered position. The abutment stop 164 prevents further rotation of the thrust deflector 122 beyond this position. In one variation, the jet propulsion unit 88 may include abutment stops 164 on both brackets 134, while including the latch 166 on only a single bracket 134.

A locking mechanism 170 desirably operates between the stops 150, 162 and the reverse thrust deflector 122 to lock the thrust deflector 122 in the set position when moved into the raised position or the lowered position. The lock mechanism 170 principally includes a drive member 172 and a follower member 174. Both members 172, 174 are positioned on the mounting area 133 of one of the support arms 128 of the thrust deflector 122. The drive member 172 is disposed on an outer side and the follower member 174 is disposed on an inner side of the arm 128.

As best seen in FIG. 6, the drive member 172 is pivotally supported on the support area 133 by a supporting bolt 176. The support bolt 176 is positioned such that the drive member 172 rocks about the support bolt 176. A forward end of the drive member includes a tang 178 that projects toward the support bracket 134 so as to cooperate with the abutment surface 156 of the movable stop element 152. A lower edge of the tang 178 extends away from the support arm 128 at an angle skewed relative to the engagement surface of the tang 178 so as to facilitate engagement of these components 156, 178, as described in greater detail below.

A lower side of the drive member 172 defines a first contact surface 177 and a second contact surface 179. The contact surfaces are disposed at different orientations and are skewed relative to each other, as seen in FIG. 6.

An inner end of the drive member 172 is pivotally coupled to an actuator 180 by a coupling 182. In the illustrated embodiment, the actuator comprises a bowden wire cable that is attached to a ball coupler 182 secured onto the inner end of the drive member 172. The drive member 172 also includes a cam element 184 located on an inner side of the drive member 172 at the inner end and opposite of the coupling 182, as best seen in FIGS. 6 and 7.

A stopper plate 186 also is fixed on an outer side of the support arm 128. The stopper plate 186 includes a first stopper portion 188 and a second stopper portion 190. The stopper portions 188, 190 are positioned at different orientations and are disposed so as to contact the first and second contact surfaces 177, 179 of the drive member 172 and limit rotation of the drive member 172, as explained in greater detail below. First and second supporting bolts 192, 194 affix the stopper plate to the support arm 138.

Figure 10:
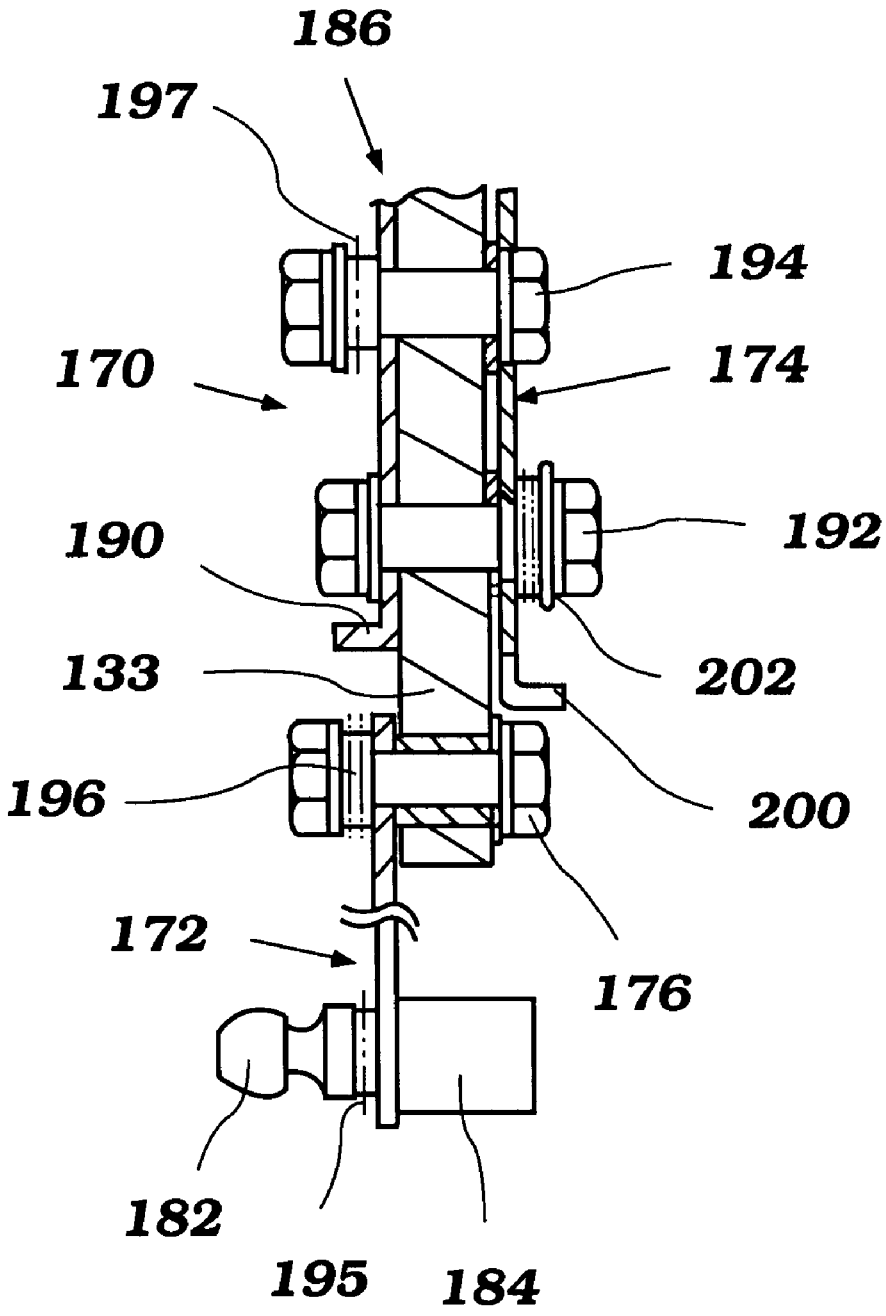
FIG. 10 is a cross-sectional view of the locking mechanism as taken along line X—X of FIG. 9.

As best seen in FIGS. 6 and 10, a torsional spring 196 operates between the support bracket 134 and the drive member 172 to bias the drive member 172 in contact with the first stopper portion 188 of the stopper plate 186. In the illustrated embodiment, the torsional spring 196 is supported on the support bolt 176, about which the drive member 172 rotates, with a first end 195 of the torsional spring 186 bearing against the actuator coupler 182 and a second end 197 of the torsional spring bearing against the second supporting bolt 194.

The follower member 174 is supported on the inner side of the support arm 128 at the mounting area 133 by the other supporting bolt 192. The follower member 172 includes an aperture 198 in which the inner side of the supporting bolt 194 is located. The aperture 198 has an elongated shape which permits the follower member 174 to rotate about the other supporting bolt 192. The cooperation between the inner side of the supporting bolt 194 and the aperture 198, however, limit the travel of the follower member 174.

The follower member 174 also includes a flange 200 that projects downward and cooperates with the cam member 184 of the drive member 170. A spring 202 operates between the follower member 174 and the support arm 128 to bias the flange 22 of the follower member 174 against the cam member 184. One end 203 of the spring 202 bears against the flange 200, while the other end 205 of the spring 202 bears against the supporting bolt 194 that cooperates with the aperture 198.

A lower end of the follower member 174 includes a second tang 204 which cooperates with the notch of the second stop latch 166. The tang 204 preferably extends inward towards the propulsion unit 88.

Figure 11:
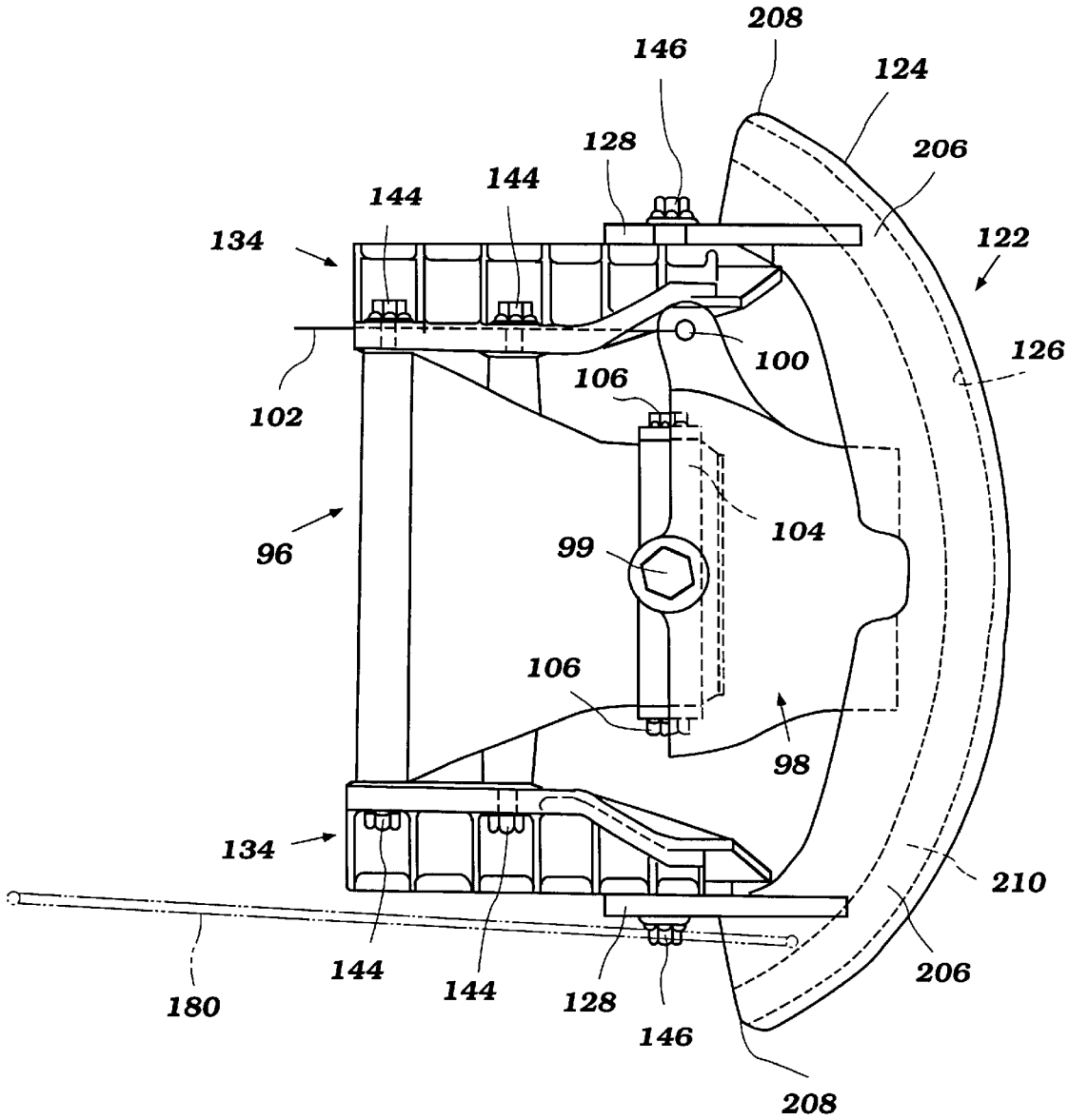
FIG. 11 is a top plan view of the discharge end of the jet propulsion unit and the mounting brackets of the reverse thrust deflector assembly, with the reverse deflector illustrated in greater detail from that depicted in FIG. 3.
Figure 12A:
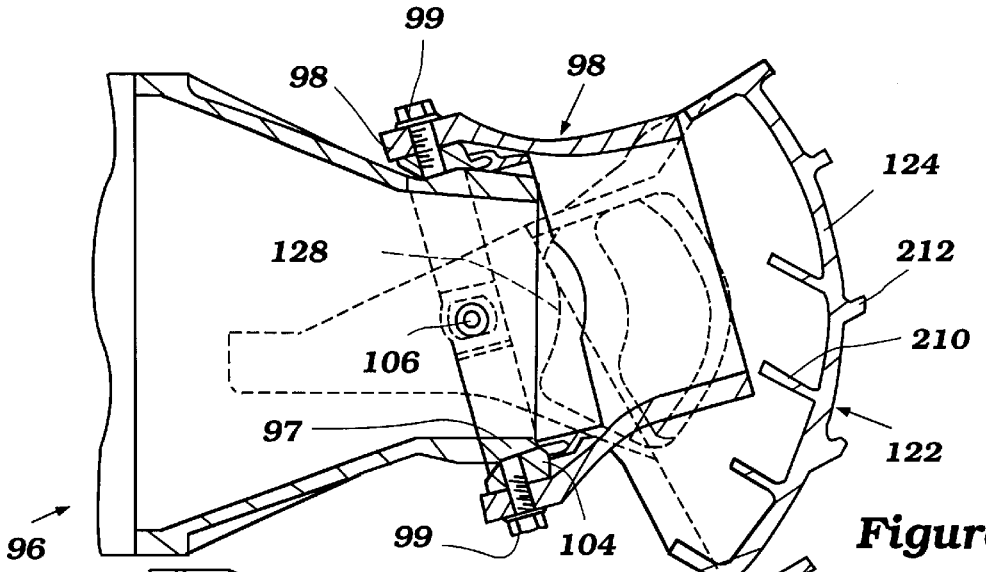
FIGS. 12A–12C illustrate a cross-sectional view of the discharge end of the jet propulsion unit and the reverse thrust deflector when in the lowered position with a steering nozzle located in a fully trimmed-up position (FIG. 12A), in an un-trimmed position (FIG. 12B) and a trimmed down position (FIG. 12C)
Figure 12B:
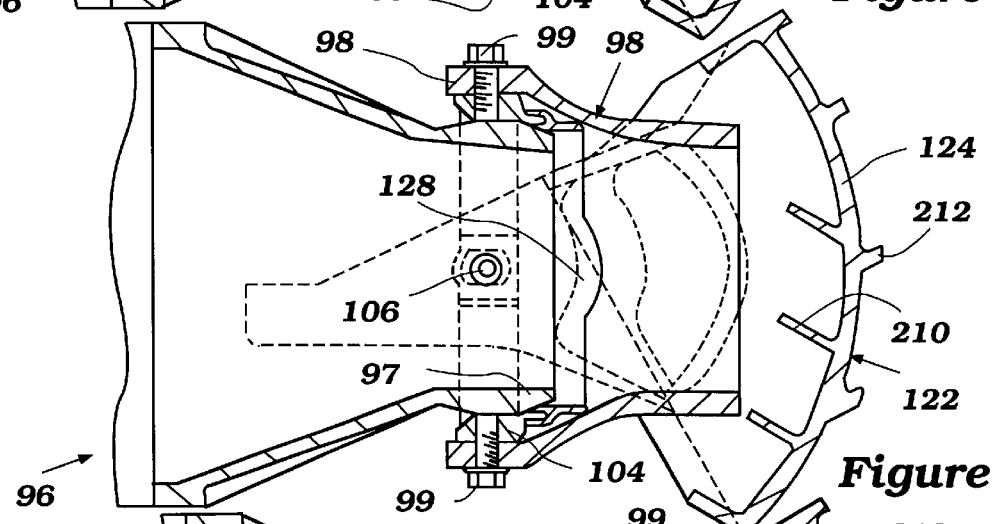
Figure 12C:
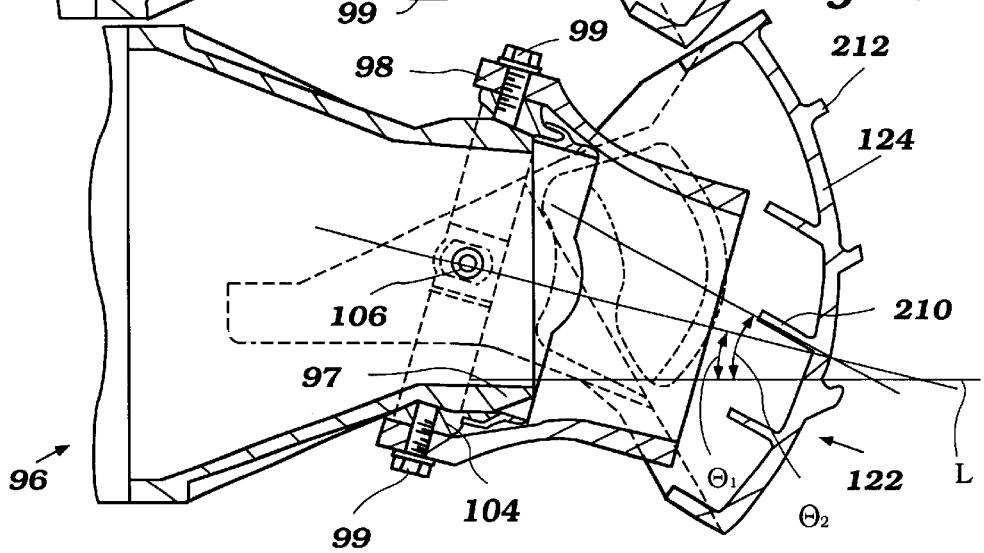
Figure 13:
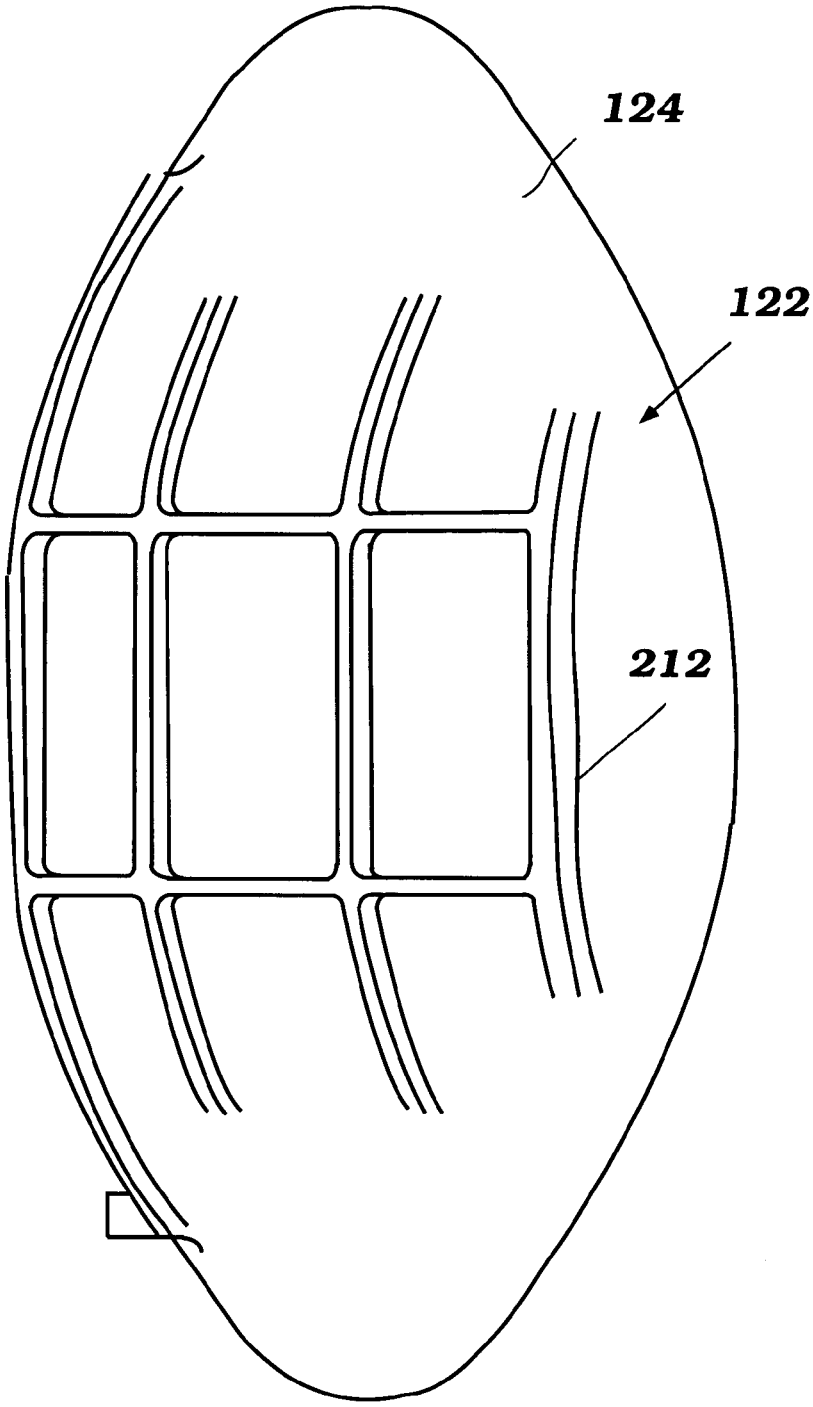
FIG. 13 illustrates a rear plan view of the thrust deflector.

FIGS. 11–13 further illustrate a preferred embodiment of the reverse thrust deflector 122. As seen in FIG. 11, the body 124 wraps around the discharge end of the steering nozzle 98 and extends beyond the outer sides of the support arms 128. The outer portions of the body 124 define forward facing outer deflectors 206 through which water is discharged in a generally forward direction through corresponding outlet ports 208, as illustrated in FIG. 11.

The thrust deflector 122 also includes at least one, and preferably a plurality of longitudinally extending ribs 210 that project towards the discharge nozzle 98 from the inner side 126. The ribs 210 channel a portion of the water issuing from the steering nozzle 98 out the side deflectors 206 to enhance the rearward thrust provided by the jet propulsion unit 88 with the thrust deflector 122 in its lowered position.

FIGS. 12A–12C illustrate the relative positions of the steering nozzle 98 and the thrust deflector 122 with the thrust deflector 122 in its lowered position and with the steering nozzle 98 at a variety of trim positions. As illustrated by these figures, the inner ribs 210 guide the water flow laterally such that a substantial amount of water issuing from the steering nozzle 98 is guided through the side deflectors 206. In order to enhance this effect, each rib 210 is desirably oriented at a greater inclined angle relative to a central axis of the propulsion unit 88 than is a discharge angle through the steering nozzle 98 when in a fully trimmed-down position. This point is illustrated best by FIG. 12C. As seen in FIG. 12C, the discharge nozzle 98 is moved into a fully trimmed-down position. Line L represents a datum which lies parallel to a central axis of the propulsion unit 88. Line O represents a central discharge axis of the steering nozzle 98. The discharge axis O of the steering nozzle 98 is skewed relative to the central axis of the propulsion unit 88, as represented in FIG. 12C by a discharge angle $\theta 1$. As seen in FIG. 12C, the discharge angle θ1 is still smaller than an inclined angle θ2 defined between each inner rib 201 of the thrust deflector 122 and the central axis of the propulsion unit 88. In this manner, water is still effectively guided toward the side deflectors 206, rather than downward when the thrust deflector 122 is lowered, even with the steering nozzle 98 in a fully trimmed down position. Although each rib 210 need not be so oriented, it is understood that this aspect of the invention can be practiced with one or more ribs 210 so oriented.

As best seen in FIGS. 12 and 13, the thrust deflector 122 desirably includes a plurality of reinforcing ribs 212 arranged on its outer surface. The reinforcing ribs 212 strengthen the thrust deflector 122 while minimizing the weight of the thrust deflector 122.

The operation of the reverse thrust deflector 122 and the associated locking mechanism 170 will now be described principally in reference to FIGS. 5, 6, 8 and 9. FIG. 5 illustrates the thrust deflector 122 in a fully raised position. The locking mechanism 170 engages the first stop 152 to prevent the thrust deflector 122 from falling. In this position, the tang 178 on the drive member 172 sits flushed against the abutment surface 156 of the first stop 152. The spring 196 assists holding the drive member 172 in this position.

To lower the reverse thrust deflector 122, the actuator 180 is moved rearward to force the inner end of the drive member 172 in the rearward direction. This, in turn, causes the drive member 172 to rotate about the support shaft 176 and compress the spring 196. The drive member 172 rotates until its second contact surface 179 contacts the second stopper portion 190 of the stopper plate 186. In this position, the tang 178 on the other end of the drive member 172 has disengaged from the first stopper abutment surface 156 and the thrust deflector 122 can be freely rotated towards the lowered position. Further rearward force applied by the actuator 180 to the drive member 172 is transmitted through the stopper plate 186 to the support arm 128 and causes the reverse thrust deflector 122 to rotate about its pivot axis defined by the bushing members 142 on the support brackets 134. This movement continues until the thrust deflector 122 is moved into its lowered position.

As noted above, the interaction between the abutment surface 132 on the support arm 128 and the abutment stop 164 establish this position. As a result, the actuator 180 cannot rotate the thrust deflector 122 further in this direction. Once the fully lowered position has been reached, the follower member 174 engages the second stop latch 166.

Figure 9:
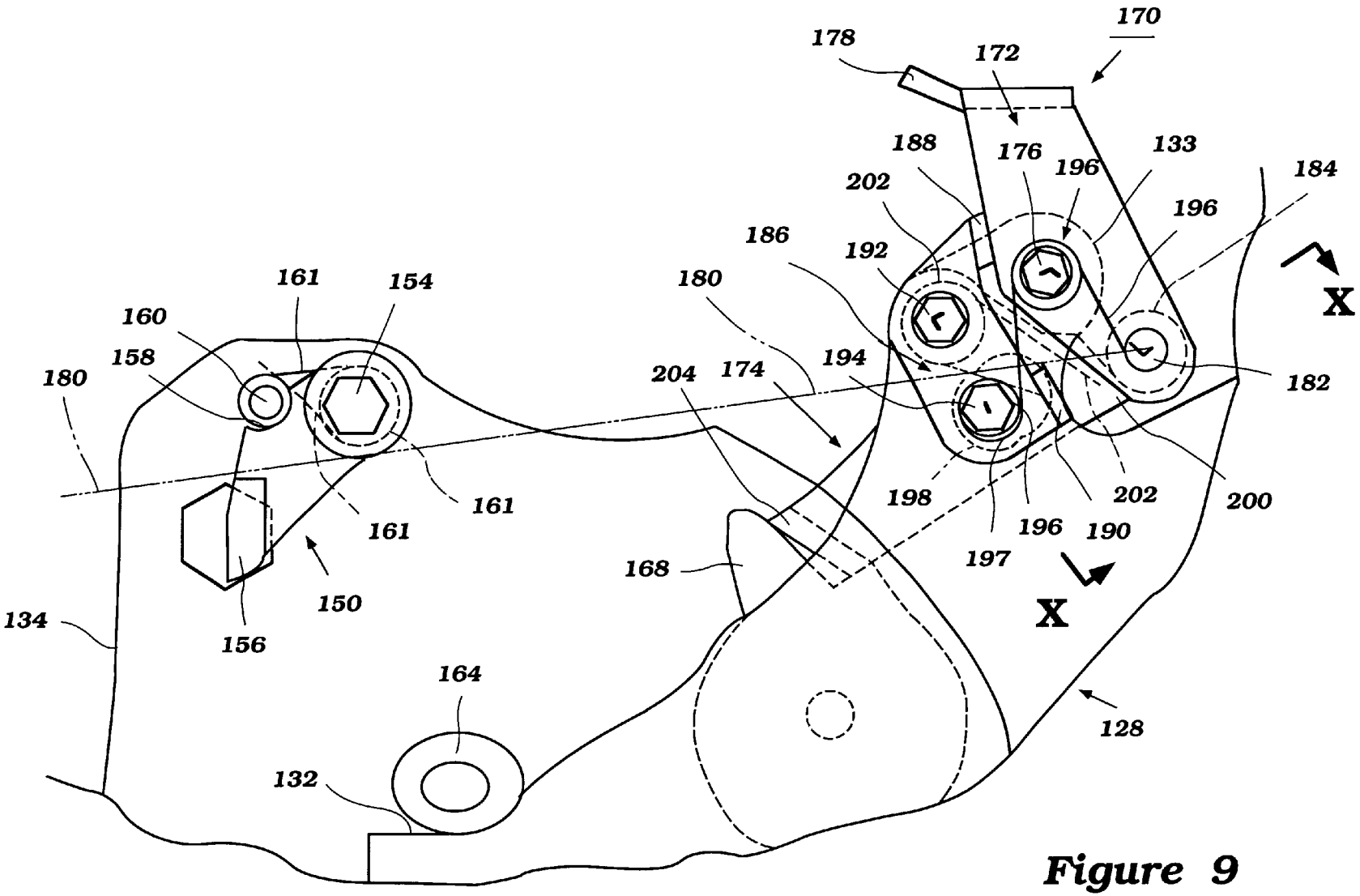
FIG. 9 is an enlarged view of a forward member of the locking mechanism engaged with a latch member of the second stop with the reverse thrust deflector in a lower position, as illustrated in FIG. 8.

As the thrust deflector 122 is lowered, the drive member 172 cause the follower member 174 to rotate away from the support arm 128 due to the interaction between the tang 200 on the follower member 174 and the cam 184 on the drive member 172. Through this rotation, the drive member 172 also cause the spring 202 between the follower member 172 and the support arm 128 to be compressed. Once the fully lowered position is reached and the force supplied by the actuator 180 is relaxes, the spring 196 between the drive member 172 and the support arm 128 causes the drive member 172 to rotate to a position where its first contact surface 177 abuts the first stopper portion 188 of the stopper plate 186, as illustrated in FIG. 9. With this movement, the cam 184 also rotates in the same direction, and the follower member 174 follows this movement under the force of the spring 202. That is, the spring 202 biases the follower member 174 to move with the drive member 172. This coupling between the tang 200 and the cam 184 establishes a lost motion connection between the thrust deflector and the corresponding stop, as will be apparent below.

As the follower member 174 moves back toward the support arm 128, as best seen in FIGS. 8 and 9, the lower tang 204 of the follower member 174 is inserted into the notch 168 of the latch 166. Due to the skewed orientation of these surfaces, as best seen in FIG. 9, this interaction between the follower member 174 and the latch 166 inhibits the thrust deflector 122 from bouncing up and down when in the lowered position. That is, this interaction prevents the thrust deflector 122 from freely moving upward toward the raised position.

The actuator 180 is pulled forward to raise the thrust deflector 122 from its lower position toward its raised position. This movement causes the drive member 174 to again rotate to a position where its second contact surface 179 abuts the second stopper portion 190 of the stopper plate 186. The follower member 174 follows this rotation and disengages from the stopper latch 166. The force applied by the actuator 188 continues to be applied to the support arm 128 through the second stopper portion 190 of the stopper plate 186 until the support arm 128 rotates to a position where the attachment point of the actuator 180 to the drive member 172 is rotated above the rotational axis of the drive member 172. At this point, the force applied through the actuator 180 causes the drive member 172 to rotate thereby bringing the first contact surface 177 into abutment for that first stopper portion 188 of the stopper plate 186. Continued force applied by the actuator 180 brings the drive member 172 into contact with the first stop 150.

As the drive member 172 engages the first stop 150, the first stop element 152 rotates as the skewed end of the tang 178 initially contact the abutment portion 156. This relative movement permits the tang 178 to engage the abutment surface 156. The spring 161 of the first stop 150, however, biases the stopper element 152 into engagement with the pin 160 such that the stopper element 152 is returned to the predetermined position, which establishes the raised position of the thrust deflector 122, once the tang 178 of the drive member 172 has cleared the upper edge of the abutment member 156. The interaction between the tang 178 and the abutment member 156 again prevents unintentional movement of the thrust deflector 122 downward.

FIGS. 14–21 illustrate another embodiment of stops and a locking mechanism used to establish and hold the thrust deflector in a raised position and in a lower position. The general construction of the reverse thrust deflector and the propulsion system, however, are substantially identical to that described above, and therefore, like reference numerals have been used to indicate like parts between the two embodiments. In addition, it is understood that the above description of these components is to apply equally to the embodiments described below, unless indicated otherwise. The following description also describes the relative positions of the components with reference to the orientation shown in FIG. 14 with the understanding that during the operation of the locking mechanism the relative positions and orientations of the components will change.

Similar to the previously described locking mechanism, the present locking mechanism 170 principally includes a drive member 172 and a follower member 174, both of which are rotatably attached onto an arm 128 of the reversed thrust deflector 122. The drive member 172 includes a central section which is pivotally supported by support bolt 176. An inner lug extends toward the reverse thrust deflector body 124 on an upper side of the drive member 172. The lug supports a coupler 182 that attaches the actuator 180 to the drive member 172. Like the previous embodiment, the actuator 180 in the present embodiment is a bowden wire cable that is attached to a ball coupler 182. The drive member 172 also includes a stopper tang 300 disposed to the front side of the coupler 182. The stopper tang 300 projects toward the mounting bracket 134 and cooperates with a front edge of the reverse thrust deflector support arm 128. An engagement tang 178 is located on a side of the drive member 172 generally opposite the coupler 182. The engagement tang 178 cooperates with a first stop 150, as described below. A second stopper tang 302 is located on a inner side of this lower section of the drive member 172. The second stopper tang 302 is arranged to cooperate with an adjacent edge of the support arm 128. A coupling tang 306 extends towards the bracket 134 at a lower end of the drive member 174 and cooperates with a portion of the follower member 174, as described below.

The follower member 174 is pivotally supported on an inner side of the support arm 128 at a location slightly below and rearward of the axis about which the drive member 172 rotates. A second support bolt 308 pivotally couples the follower member 174 to the inner side of the support arm 128. The follower member 174 includes an outer arm with an engagement tang 200 which extends outward from the mounting bracket 134 and toward the drive member 172. The engagement tangs 306, 200 on the drive member 172 and the following member 174 are disposed in a overlapping manner such that the engagement tang 200 of the follower member 174 lies on an inner side of the drive member 172 and the engagement tang 306 of the drive member 172 extends over a portion of the follower member 174. In this manner, the drive and follower members 172, 174 are coupled together so as to move together under some operating conditions. This coupling, however, provides a lost motion connection to permit one member to move relative to the other under other operating conditions.

Figure 14:
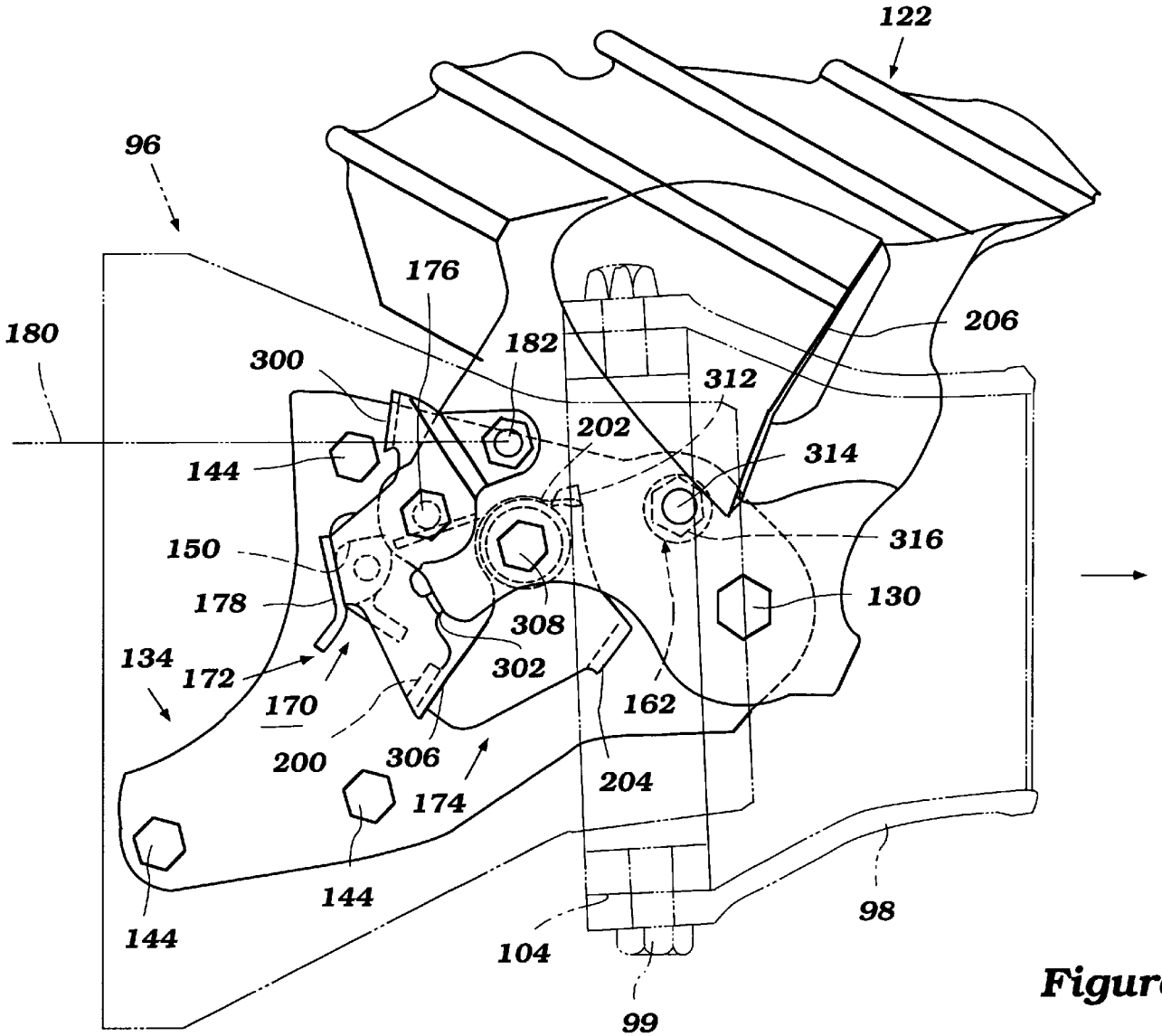
FIG. 14 is a side elevational view of a rear thrust deflector assembly, including a locking mechanism, configured in accordance with another preferred embodiment of the present invention as positioned on a discharge end of a jet propulsion unit of a personal watercraft and with the reverse thrust deflector in a raised position.
Figure 15:
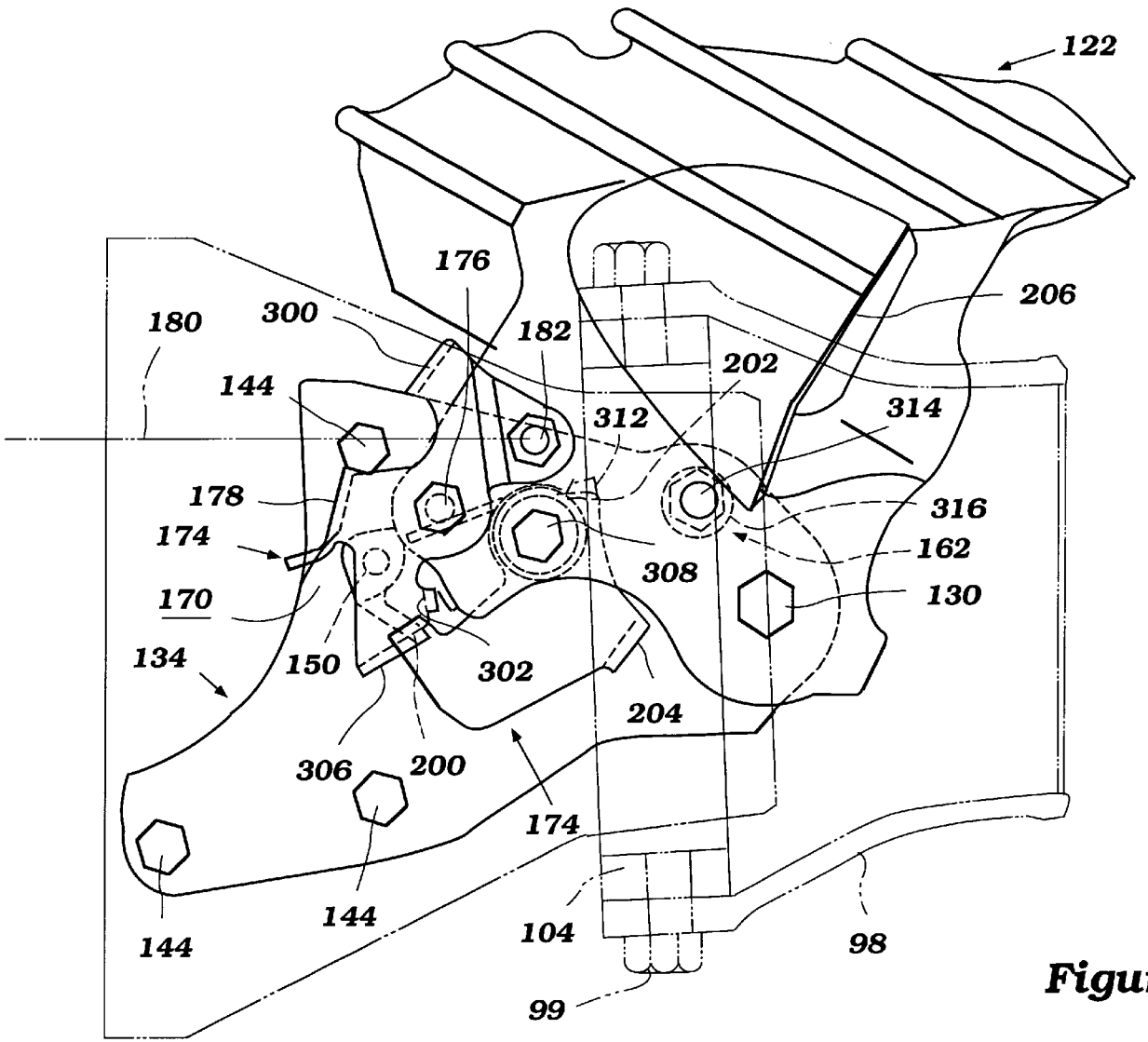
FIG. 15 is a side elevational view of the reverse thrust deflector assembly of FIG. 14, with the reverse thrust deflector in a raised position and with the locking mechanism in a released position.
Figure 19:
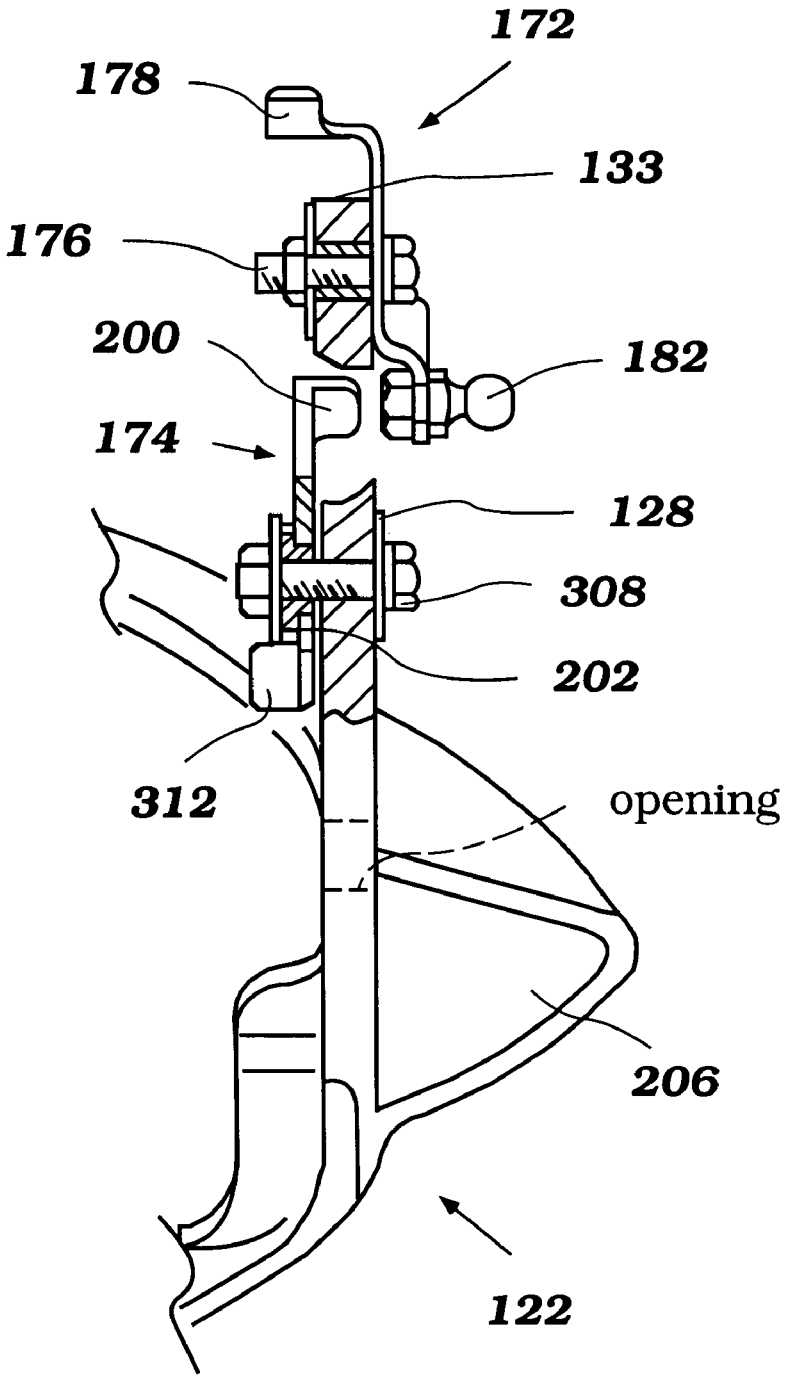
FIG. 19 is a cross-sectional view of the latching mechanism as taken along line XIX—XIX of FIG. 16.
Figure 20:
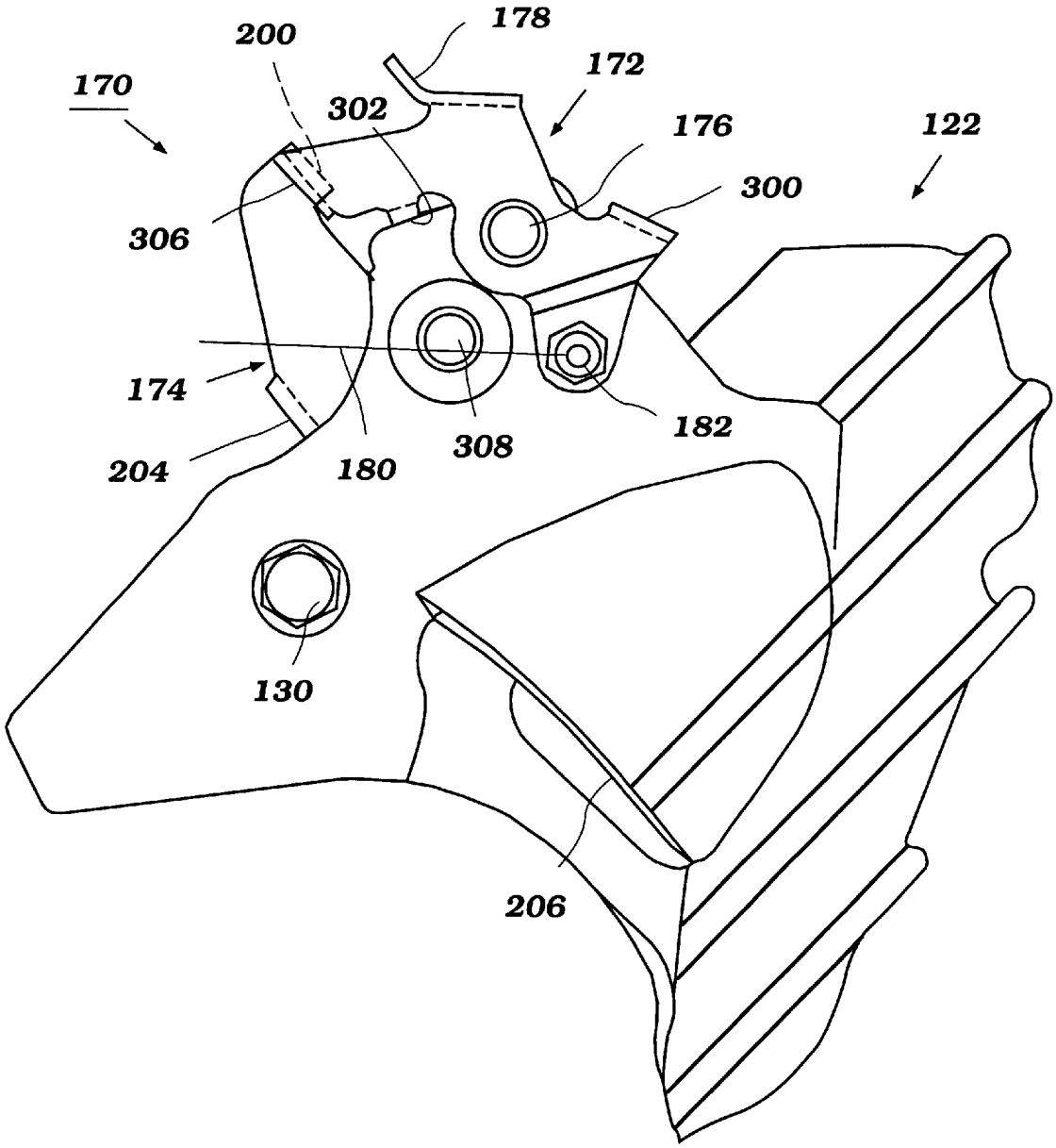
FIG. 20 is a side elevational view of the thrust deflector and the latching mechanism of FIG. 14.
Figure 21:
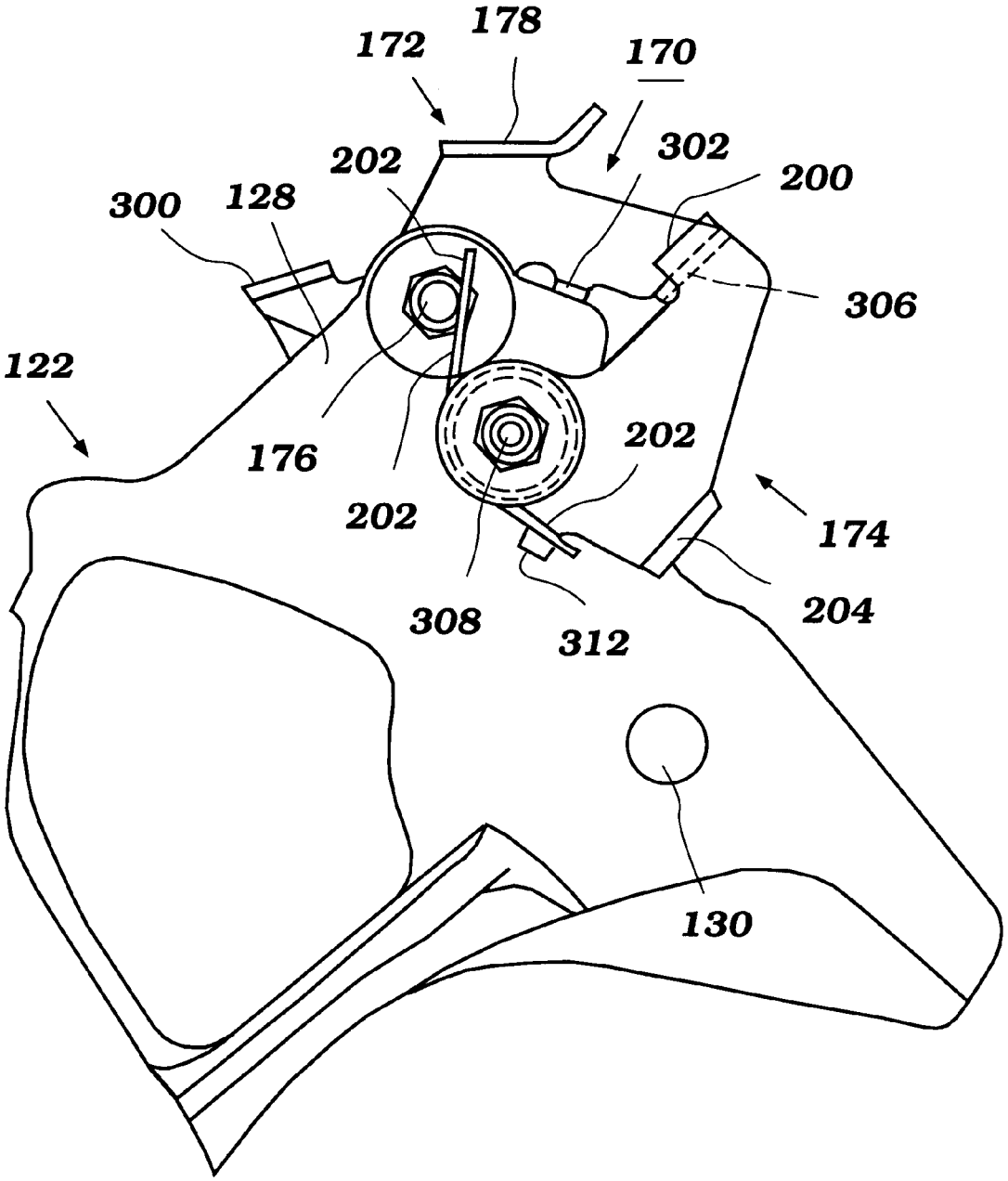
FIG. 21 is a view of the locking mechanism as attached to the thrust deflector from a perspective inside the thrust deflector.

As best seen in FIGS. 14, 19 and 21, a torsion spring 202 operates between the support arm 128 and the follower member 174 to bias the engagement tangs 306, 200 to move together. As a result, the follower member 174 generally follows the movement of the drive member 172. In the illustrated embodiment, the follower member 174 includes a tang 312 against which the end of the torsion spring 202 acts. The opposite end of the torsion spring 202 acts against a lower portion of the supporting bolt 176 about which the drive member 172 rotates.

The follower member 174 also includes a stop engagement tang 204 disposed at a orientation different from the engagement tang 178 of the drive member 172. In an illustrated embodiment, the engagement tang 204 of the follower member 174 is disposed about 120° apart from the engagement tang 178 of the drive member 172. The engagement tang 204 is positioned so as to cooperate with the second stop 162 when the reverse thrust deflector 122 is moved into the lowered position.

As seen in FIG. 14, the locking mechanism cooperates with the first stop 150 and the second stop 162. The first stop 150 is disposed forward of the second stop 162 on one of the support brackets 134. Although the present embodiment describes the locking mechanism and stops located on one side of the reverse thrust deflector, it is appreciated that these components can be located on the other side of the jet propulsion unit, as well as on both sides where simultaneous actuation is used.

The first stop 150 includes an abutment surface 156 which in the illustrated embodiment faces forward in generally a vertically orientation. An upper edge of the engagement surface 156 is rounded to permit the engagement tang 178 to slide around the front side of the first stop 150, as described in greater detail below.

Figure 18:
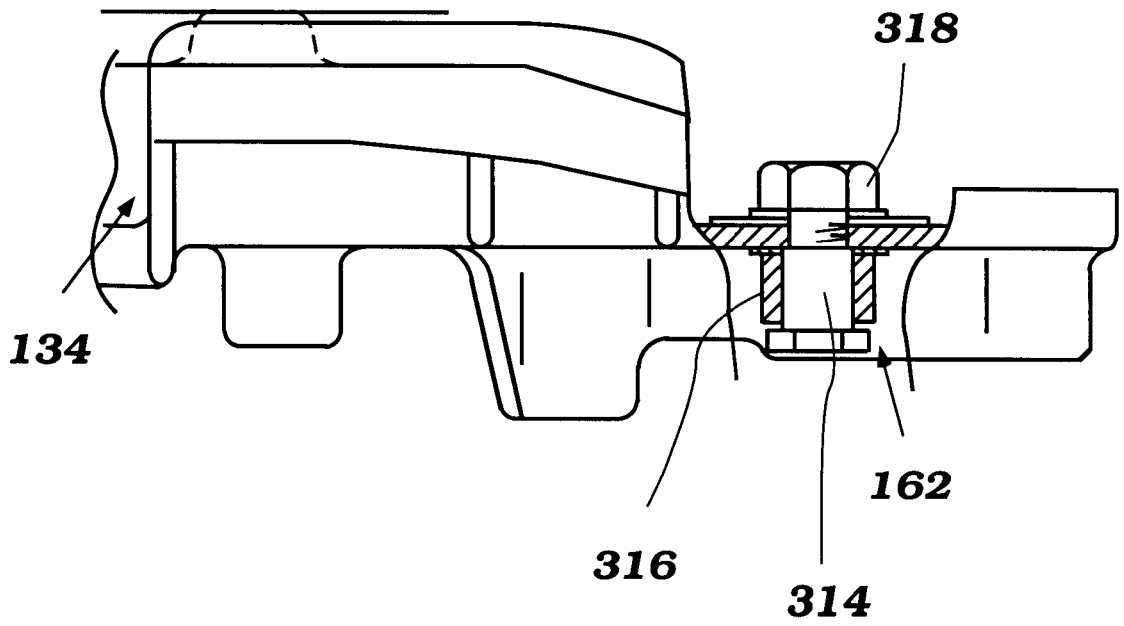
FIG. 18 is an enlarged top plan view of the second stop attached to a section of a mounting bracket

With reference to FIGS. 14 and 18, the second stop 162 extends outward from the support bracket 134 at a location near the pivot point 130 of the reverse thrust deflector 122. In the illustrated embodiment, the second stop 162 includes a support shaft 314 that supports a collar 316 which rotates about the shaft 314. A bolt 318 is disposed on the inner side of the bracket 134 to secure the support shaft 314 onto the bracket 134.

The operation of the locking mechanism 172 and the actuation of the reverse thrust deflector 122 will now be described with reference principally to FIGS. 14, 15, 16 and 17. FIG. 14 illustrated the reverse thrust deflector 122 in a raised position and the locking mechanism 174 engaged with the first stop 150. The engagement tang 178 of the drive member 172 contacts and sits squarely against the abutment surface 156 of the first stop 150. The torsion spring 202, which acts on the follower member 174, biases the stop engagement tang 178 against the first stop 150 through the lost motion connection between the drive member 172 and the follower member 174 (i.e., through the overlapping engagement tangs 306, 200 between the drive and follower members 172, 174).

The locking mechanism 170 is released from the first stop 152 to lower the reverse thrust deflector 122. This is accomplished by moving the actuator 180 to rotate the drive member 172 and move the stop engagement tang 178 forward and upward. As appreciated from FIG. 15, which illustrates the locking mechanism 170 is a released position, the drive member 172 continues to rotate unit the first stopper tang 300 contacts the corresponding edge of the support arm. The actuator 180 then effectively acts directly against the support arm 128 of the thrust deflector 122, to move the thrust deflector 122 towards the lowered position.

Figure 16:
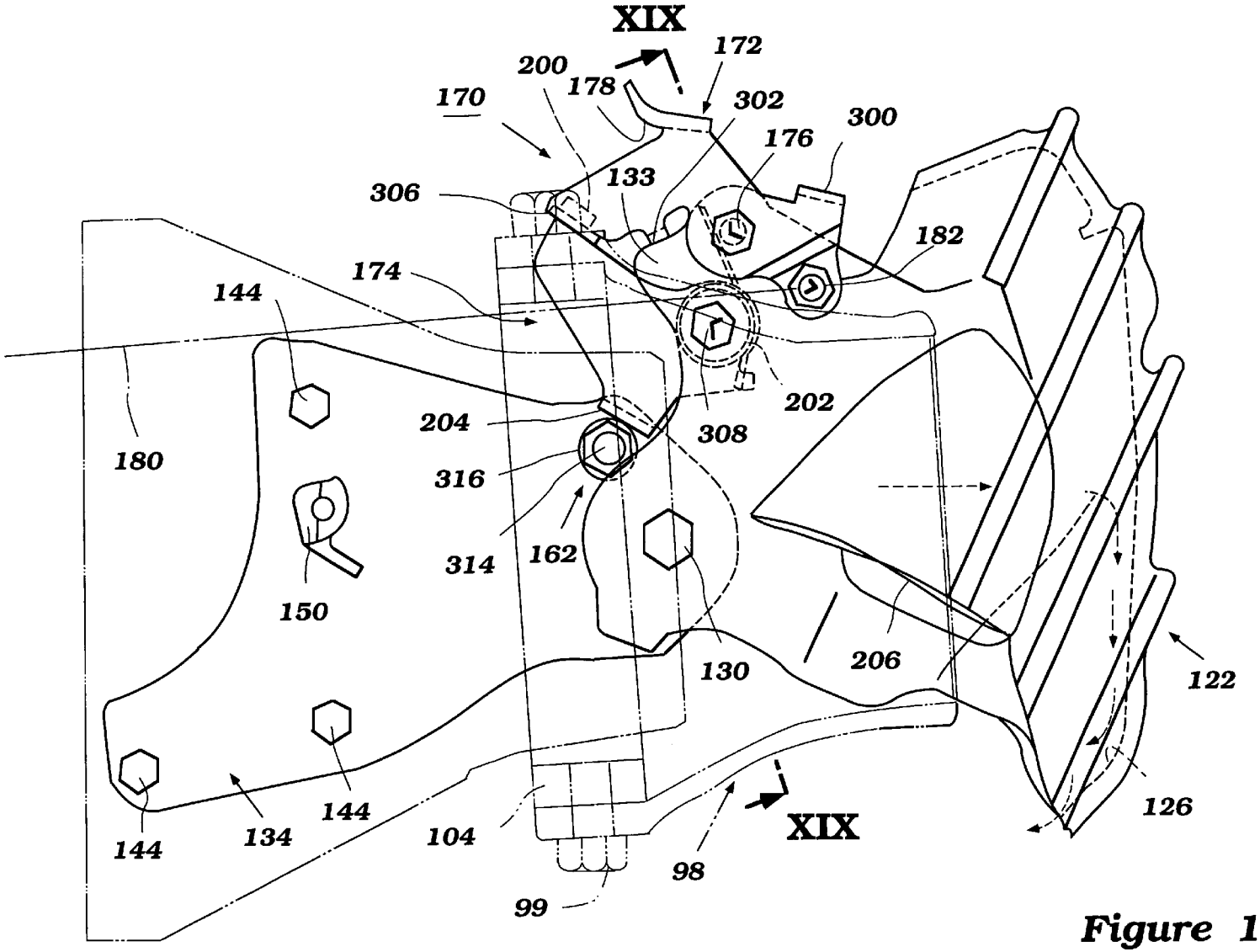
FIG. 16 is a side elevational view of the reverse rust deflector assembly shown in FIG. 13, with the reverse thrust deflector in a lower position and with the locking mechanism in a locked position.

This motion continues in this manner until the pivot shaft 176 of the drive member 172 rotates above the attachment point between the actuator 180 and the drive member 172. At this point, the rearward force applied by the actuator 180 causes the drive member 172 to rotates in an opposite direction. The bias of the spring 202 also assist moving the drive member 172 in this direction. The drive member 172 continues to rotate in this direction until the second stopper tang 302 engages the corresponding edge of the support arm 128 of the thrust deflector 122. The follower member 174 is moved into an engagement position, as seen in FIG. 16.

The stop engagement tang 204 of the follower member 174 moves into contact with the collar 316 of the second stop 162 when the thrust deflector 122 moves into the lowered position. The engagement between these components inhibits further lowering of the thrust deflector 122. In this manner, the second stop 162 establishes the lowered position of the thrust deflector 122. In addition, the spring 202 furthers this engagement by biasing the stop engagement tang 204 against the stop collar 316. The resulting frictional interaction created under this force inhibits unintentional movement of the thrust deflector 122 from this position. For example, the engagement of the locking mechanism 170 to the second stop 162 inhibits the reverse thrust deflector 122 from bouncing up and down during operation of the watercraft in reverse.

Figure 17:
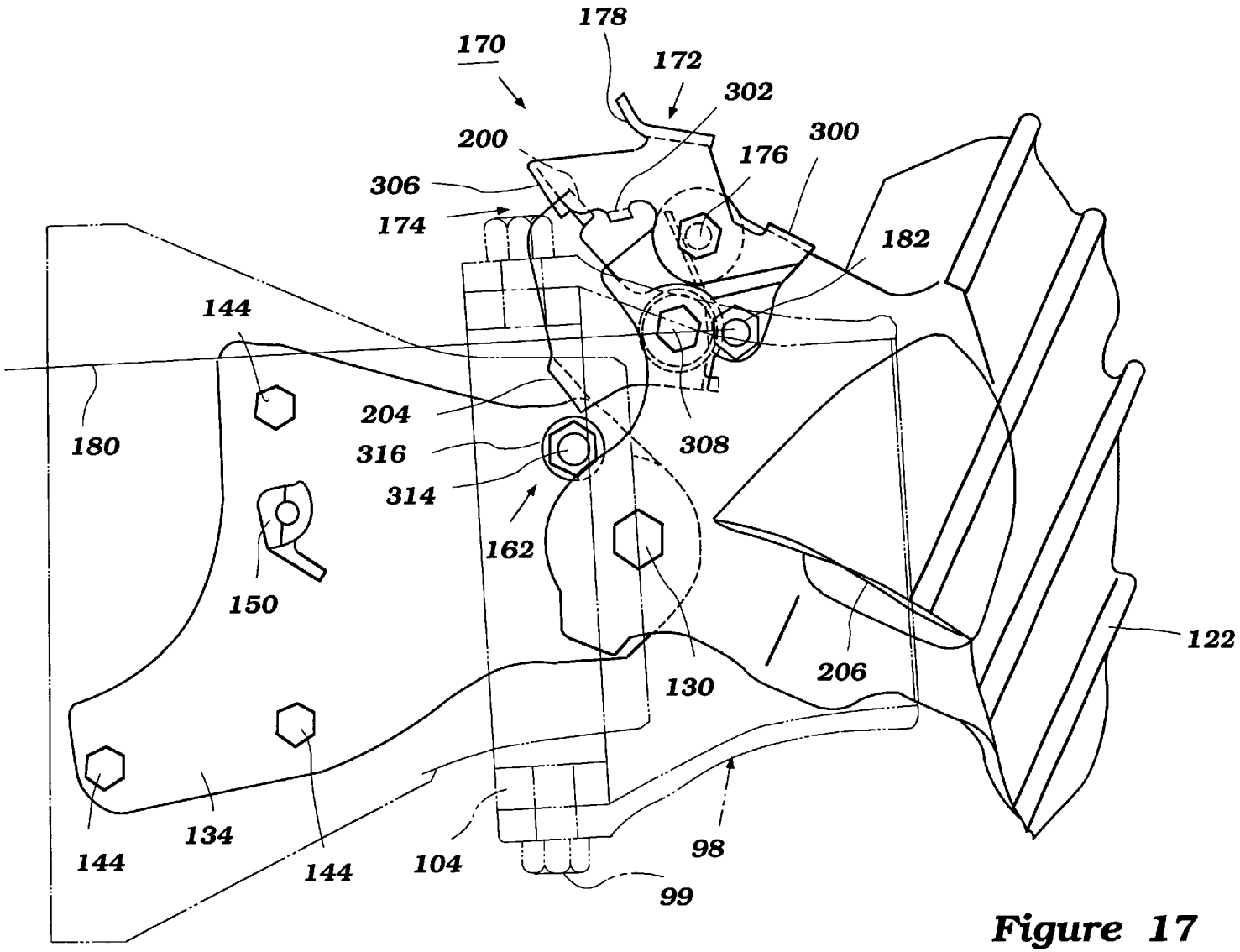
FIG. 17 is a side elevational view of the reverse thrust deflector assembly of FIG. 16, with the reverse thrust deflector in the lowered position and with the locking mechanism in a released position.

The locking mechanism 170 is released from the second stop 162 to raise the thrust deflector 122 from the lower position. The actuator 180 pulls the lug of the drive member 172 forward, which causes the first stopper tang 300 of the drive member to rotate toward the corresponding edge of the reverse thrust deflector. This motion, as illustrated in FIG. 17, also causes the follower member 174 to rotate and pull the stop engagement tang 204 away from the second stop 162. The locking mechanism 170 thus releases from the second stop 162 and the actuator 180 raises the thrust deflector with further forward movement of the actuator.

The drive member 172 rotates to a position where the second stopper tang 302 engages the corresponding edge of the support arm 128 once the point of attachment of the actuator 180 to the drive member 172 rotates to a position above the rotational axis of the drive member 172. The stop engagement tang 178 of the drive member thus moves into a position for engagement with the first stop 150.

The cooperating curved surfaces of the leading portion of the stop engagement tang 178 and the upper edge of the first stop 150 allow the tang 178 to slip around and onto the front side of the first stop 150. The ability of the drive member 172 to rotate as engagement occurs also facilitates the tang 178 moving into onto the front side of the stop engagement surface 156. The spring 202 biases the tang 178 against the stop engagement surface 156 to prevent unintentional lowering of the thrust deflector 122. The engagement between the stop engagement tang of the drive member and the first stop and the engagement between second stopper tang of the drive member and the corresponding edge on the support arm together prevent further raising of the reverse thrust deflector and establish the raised position.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A jet propulsion unit for a watercraft comprising an impeller disposed within a housing assembly, a nozzle arranged downstream of the impeller, a thrust deflector pivotally supported relative to the nozzle and movable between a first position and a second position, the thrust deflector being disposed relative to the nozzle so as to redirect at least a portion of a water stream issuing from the nozzle when the thrust deflector is moved into the second position, first and second stops which cooperate with the thrust deflector to define the first and second positions, a releasable locking mechanism being attached to the thrust deflector and engaging the first stop and the second stop when the thrust deflector is positioned in the first position and the second position, respectively, and a lost motion connection between the thrust deflector and the locking mechanism so as to release the locking mechanism from one of the stops to move the thrust deflector from at least one of the first and second positions.

2. A jet propulsion unit as in claim 1, wherein the first and second stops are fixedly disposed on the jet propulsion unit near the thrust deflector and are arranged relative to the locking mechanism to inhibit unintentional movement of the trust deflector with the locking mechanism engaging the respective stop.

3. A jet propulsion unit as in claim 2, wherein at least a first portion of the locking mechanism and the first stop cooperate, when engaged in the first position, to inhibit the thrust deflector from moving toward the second position, and at least a second portion of the locking mechanism and the second stop cooperate, when engaged in the second position, to inhibit the thrust deflector from moving toward the first position.

4. A jet propulsion unit as in claim 3, wherein the first and second portions of the locking mechanisms are independently journaled to the thrust deflector, and the first and second portions are biased to move together.

5. A jet propulsion unit as in claim 4 additionally comprising an actuator coupled to the first portion.

6. A jet propulsion unit as in claim 2 additionally comprising a bracket assembly supporting the thrust deflector about the nozzle, and the stops being disposed on the bracket assembly.

7. A jet propulsion unit as in claim 6, wherein the first stop is disposed forward of the second stop on the bracket assembly.

8. A watercraft as in claim 6, wherein the bracket assembly is mounted onto the jet propulsion unit.

9. A jet propulsion unit as in claim I additionally comprising an actuator coupled to the locking mechanism.

10. A jet propulsion unit as in claim 9, wherein the locking mechanism comprises first and second members that are disposed on the thrust deflector at a location above a pivot axis about which the thrust deflector rotates when moving between the first and second positions, and the actuator is coupled to the first member.

11. A jet propulsion unit as in claim 10, wherein the first and second members are independently journaled to the thrust deflector and are biased to move together.

12. A jet propulsion unit as in claim 1, wherein the lost motion connection is arranged to release the locking mechanism from either stop to move the thrust deflector from both the first position and from the second position.

13. A jet propulsion unit as in claim 1, wherein the thrust deflector is journaled relative to the nozzle so as to pivot about a generally horizontal axis.

14. A jet propulsion unit as in claim 1, wherein the nozzle is journaled relative to the jet propulsion unit to rotate about a generally vertically-oriented steering axis.

15. A jet propulsion unit as in claim 14, wherein the nozzle is also journaled relative to the jet propulsion unit to rotate about a trim axis that lie generally normal to the steering axis.

16. A jet propulsion unit as in claim 15, wherein the nozzle is rotatable between a fully-trimmed up position and a fully-trimmed down position, in which a central axis of the nozzle is skewed at a discharge angle relative to a central axis of the jet propulsion unit, the thrust deflector includes at least one inclined, laterally extending rib that is disposed on a side of the trust deflector facing the nozzle and that is oriented at an inclined angle relative to the central axis of the jet propulsion unit, and the inclined angle of the rib is larger than the discharge angle of the nozzle when fully trimmed down.

17. A watercraft comprising a hull defining a rider's area and an engine compartment, an engine being disposed within the engine compartment and including an output shaft, a jet propulsion unit being coupled to the engine output shaft and including an impeller disposed within a housing assembly, and a nozzle arranged downstream of the impeller, a thrust deflector pivotally supported relative to the nozzle and movable between a first position and a second position, the thrust deflector being disposed relative to the nozzle so as to redirect at least a portion of a water stream issuing from the nozzle when the thrust deflector is moved into the second position, first and second stops which cooperate with the thrust deflector to define the first and second positions of the thrust deflector, a releasable locking mechanism being attached to the thrust deflector and engaging the first stop and the second stop when the thrust deflector is positioned in the first position and the second position, respectively, and a lost motion connection between the thrust deflector and the locking mechanism so as to release the locking mechanism from one of the stops to move the thrust deflector from at least one of the first and second positions.

18. A watercraft as in claim 17 additionally comprising a bracket assembly supporting the thrust deflector about the nozzle, and the stops being disposed on the bracket assembly.

19. A watercraft as in claim 18, wherein the bracket assembly is mounted onto the jet propulsion unit.

20. A watercraft as in claim 17 additionally comprising an actuator coupled to the locking mechanism.

21. A watercraft as in claim 20, wherein the locking mechanism comprises first and second members that are disposed on the thrust deflector at a location above a pivot axis about which the thrust deflector rotates when moving between the first and second positions, and the actuator is coupled to the first member.

22. A watercraft as in claim 21, wherein the first and second members are independently journaled to the thrust deflector and are biased to move together.

23. A watercraft as in claim 20 additionally comprising a remote operator disposed near the rider's area and coupled to the thrust deflector by the actuator to move the thrust deflector between the first and second positions.

24. A watercraft as in claim 17, wherein the hull includes a tunnel in which at least a portion of the jet propulsion unit is disposed, and the stops are fixedly coupled near the thrust deflector within the tunnel.

25. A watercraft as in claim 24, wherein the stops are disposed on the jet propulsion unit.

26. A watercraft as in claim 17, wherein the nozzle is rotatable between a fully-trimmed up position and a fully-trimmed down position, in which a central axis of the nozzle is skewed at a discharge angle relative to a central axis of the jet propulsion unit, the thrust deflector includes at least one inclined, laterally extending rib that is disposed on a side of the thrust deflector facing the nozzle and that is oriented at an inclined angle relative to the central axis of the jet propulsion unit, and the inclined angle of the rib is larger than the discharge angle of the nozzle when fully trimmed down.

27. A jet propulsion unit for a watercraft comprising an impeller disposed within a housing assembly, a nozzle arranged downstream of the impeller, a thrust deflector pivotally supported relative to the nozzle and movable between a first position and a second position, means for establishing the first and second positions of the thrust deflector, the thrust deflector being disposed relative to the nozzle so as to redirect at least a portion of a water stream issuing from the nozzle when moved into the second position, a first stop fixed relative to the propulsion unit, a second stop fixed relative to the propulsion unit, means for releasably locking the thrust deflector directly to the first stop when the thrust deflector is in the first position and releasably locking the thrust deflector directly to the second stop when the thrust deflector is in the second position, and release means for releasing the thrust deflector from the locked first and second positions so as to move the thrust deflector from the respective position.

28. A jet propulsion unit as in claim 27 additionally comprising an actuator coupled to the release means.

29. A jet propulsion unit as in claim 27 in combination with a watercraft having a hull defining a rider's area and an engine compartment, the jet propulsion unit being disposed on an underside of the hull, an engine disposed within the engine compartment and coupled to the jet propulsion unit to drive the impeller, and a remote operator disposed near the rider's area and coupled to the thrust deflector by an actuator mechanism to move the thrust deflector between the first and second positions.

30. A jet propulsion unit as in claim 27 additionally comprising a bracket assembly supporting the thrust deflector about the nozzle.

31. A jet propulsion unit as in claim 27, wherein the thrust deflector is journaled relative to the nozzle so as to pivot about a generally horizontal axis.

32. A jet propulsion unit as in claim 27, wherein the nozzle is journaled relative to the jet propulsion unit to rotate about a generally vertically-oriented steering axis.

33. A jet propulsion unit as in claim 32, wherein the nozzle is also journaled relative to the jet propulsion unit to rotate about a trim axis that lie generally normal to the steering axis.

34. A jet propulsion unit as in claim 33, wherein the nozzle is rotatable between a fully-trimmed up position and a fully-trimmed down position, in which a central axis of the nozzle is skewed at a discharge angle relative to a central axis of the jet propulsion unit, the thrust deflector includes at least one inclined, laterally extending rib that is disposed on a side of the thrust deflector facing the nozzle and that is oriented at an inclined angle relative to the central axis of the jet propulsion unit, and the inclined angle of the rib is larger than the discharge angle of the nozzle when fully trimmed down.

35. A jet propulsion unit as in claim 27, wherein the first stop is pivotally fixed relative to the nozzle.

36. A jet propulsion unit for a watercraft comprising an impeller disposed within a housing assembly, a discharge nozzle and a steering nozzle arranged downstream of the impeller and in series such that the steering nozzle receives water issuing from the discharge nozzle, a thrust deflector pivotally movable between a first position and a second position, the thrust deflector being disposed relative to the steering nozzle so as to redirect at least a portion of a water stream issuing from the steering nozzle when the thrust deflector is moved into the second position, an actuator connected to the steering nozzle, and a bracket assembly supporting the thrust deflector, the bracket assembly including a pair of arms which are attached to the discharge nozzle and extend at least toward the steering nozzle, the thrust deflector being pivotally coupled to the arms, wherein at least one of the arms defines a hollow space extending along side the jet propulsion unit, and at least a portion of the actuator is disposed within the hollow space.

37. A jet propulsion unit as in claim 36, wherein the thrust deflector is pivotally coupled to the arms at a point near an effluent end of the discharge nozzle.

38. A jet propulsion unit as in claim 36, wherein the arms of the bracket assembly extend along at least a portion of the sides of the steering nozzle.

39. A jet propulsion unit as in claim 35, wherein the thrust deflector includes at least one side vent and a forward-facing side deflector communicating with the vent, the side deflector including an outlet located to an outer side of the respective bracket arm.

40. A jet propulsion unit as in claim 35 additionally comprising first and second stops which cooperate with the thrust deflector to define the first and second positions of the thrust deflector, a releasable locking mechanism being attached to the thrust deflector and engaging the first stop and the second stop when the thrust deflector is positioned in the first position and the second position, respectively, and a lost motion connection between the thrust deflector and the locking mechanism so as to release the locking mechanism from one of the stops to move the thrust deflector from at least one of the first and second positions.

41. A jet propulsion unit as in claim 40, wherein the first and second stops are fixedly disposed on the jet propulsion unit near the thrust deflector and are arranged relative to the locking mechanism to inhibit unintentional movement of the thrust deflector with the locking mechanism engaging the respective stop.

42. A jet propulsion unit as in claim 41, wherein at least a first portion of the locking mechanism and the first stop cooperate, when engaged in the first position, to inhibit the thrust deflector from moving toward the second position, and at least a second portion of the locking mechanism and the second stop cooperate, when engaged in the second position, to inhibit the thrust deflector from moving toward the first position.

43. A jet propulsion unit as in claim 42, wherein the first and second portions of the locking mechanism are independently journaled to the thrust deflector, and the first and second portions are biased to move together.

44. A jet propulsion unit as in claim 43 additionally comprising another actuator coupled to the first portion.

45. A jet propulsion unit as in claim 35 in combination with a watercraft having a hull defining a rider's area and an engine compartment, the jet propulsion unit being disposed on an underside of the hull, an engine disposed within the engine compartment and coupled to the jet propulsion unit to drive the impeller, and a remote operator disposed near the rider's area and coupled to the thrust deflector by an actuator mechanism to move the thrust deflector between the first and second positions.

46. A jet propulsion unit as in claim 39, wherein the steering nozzle is rotatable between a fully-trimmed up position and a fully-trimmed down position, in which a central axis of the nozzle is skewed at a discharge angle relative to a central axis of the jet propulsion unit, the thrust deflector includes at least one inclined, laterally extending rib that is disposed on a side of the thrust deflector facing the nozzle and that is oriented at an inclined angle relative to the central axis of the jet propulsion unit, and the inclined angle of the rib is larger than the discharge angle of the nozzle when fully trimmed down.

* * * * *